US006085059A

United States Patent [19]

Haneda et al.

[11] Patent Number: 6,085,059

[45] Date of Patent: Jul. 4, 2000

[54] COLOR-TONER-USE FIXING UNIT AND COLOR IMAGE FORMING APPARATUS

[75] Inventors: Satoshi Haneda; Kunio Shigeta, both of Hachioji, Japan

[73] Assignee: Konica Corporation, Japan

[21] Appl. No.: 09/309,234

[22] Filed: May 10, 1999

[30] Foreign Application Priority Data

| | | | |
|---|---|---|---|
| May 12, 1998 | [JP] | Japan | 10-128917 |
| Jun. 5, 1998 | [JP] | Japan | 10-157741 |
| Jun. 16, 1998 | [JP] | Japan | 10-168379 |

[51] Int. Cl.[7] ..... G03G 15/20

[52] U.S. Cl. ..... 399/333; 399/69

[58] Field of Search ..... 118/59, 60; 219/216; 399/330, 333, 336, 69

[56] References Cited

U.S. PATENT DOCUMENTS

| | | | |
|---|---|---|---|
| 3,948,214 | 4/1976 | Thettu | 118/60 |
| 5,123,151 | 6/1992 | Uehara et al. | 29/130 |
| 5,679,462 | 10/1997 | Soga et al. | 428/447 |
| 5,724,638 | 3/1998 | Isogai et al. | 399/333 |

*Primary Examiner*—Arthur T. Grimley
*Assistant Examiner*—Hoang Ngo
*Attorney, Agent, or Firm*—Jordan B. Bierman; Bierman, Muserlian and Lucas

[57] ABSTRACT

In a color image forming apparatus provided with a toner image forming device for forming a color toner image on a transfer sheet; and a pair of cylindrical fixing rollers for nipping the transfer sheet bearing the color toner image formed by the toner image forming device therebetween and for fixing the color toner image on the transfer sheet; at least one of the pair of cylindrical fixing rollers including a heat ray irradiating device, a cylindrical light transmitting base member at an inside of which the heat ray irradiating device is provided, an elastic layer provided on the cylindrical light transmitting base member, and a heat ray absorbing layer provided on the cylindrical light transmitting base member and for absorbing and substantially shutting the heat ray passing the cylindrical light transmitting base member.

21 Claims, 15 Drawing Sheets

COLOR-TONER-USE FIXING UNIT AND COLOR IMAGE FORMING APPARATUS

BACKGROUND OF THE INVENTION

The present invention relates to a color-toner-use fixing unit and a color image forming apparatus both in a copying machine, a printer and a facsimile machine, and in particular, to a color-toner-use fixing unit which is capable of instant heating and is for quick start fixing, and a color image forming apparatus employing the same.

Heretofore, as a fixing unit used for a copying machine, a printer and a facsimile machine, those of a heat roller fixing system have been used widely for a low speed machine up to a high speed machine and for machines for monochromatic images and full-color images, as a stable and highly sophisticated one.

In the fixing unit of a conventional heat roller fixing system, however, when heating a transfer material and toner, there has been a problem that it is disadvantageous for energy conservation because of poor effect of energy conservation because a fixing roller with great heat capacity needs to be heated, and a long time is required for warming a fixing unit in the course of printing, resulting in a long printing time (warming-up time).

A fixing unit of a film fixing system wherein a film (heat fixing film) is used to solve the above-mentioned problem, a heat roller is changed to a heat fixing film having an ultimate thickness and low heat capacity, heat conduction efficiency is extremely improved by bringing the temperature-controlled heater (ceramic heater) into direct contact with the heat fixing film, and thereby, energy conservation and quick start which hardly requires warming-up time are achieved, and a color image forming apparatus employing the fixing unit of a film fixing system, have been proposed, and they are used recently.

Fixing methods wherein a light transmitting base body representing a variation of the heat roller is used as a fixing roller, and heat ray emitted from a halogen lamp provided inside is projected on toner to heat and fix the toner and quick start requiring no warming-up time is achieved, are disclosed in TOKKAISHO Nos. 52-106741, 52-82240, 52-102736 and 52-102741.

However, in the method disclosed by TOKKAISHO No. 52-106741 wherein heat ray or heat wave from a halogen lamp is projected through a light transmitting base body to heat and fix toner, there is a problem that it is difficult to melt and fix with heat ray due to different spectral characteristics when applying to color image forming, and it is especially difficult to melt and fix color toner images having different spectral characteristics and superposed on a transfer material and having a thick toner layer, with heat ray, although energy conservation and quick start in which a warming-up time is shortened are achieved. Color reproduction and a gloss resulting from sufficient fusion of toner are needed, and as color toner, there is used polyester resin with low molecular weight having sharp melt property, and a soft roller which forms a sufficient nipping section for fixing is generally used in the fixing unit.

SUMMARY OF THE INVENTION

An object of the invention is to provide a color-toner-use fixing unit wherein the problems stated above are solved, color toner which is difficult to be fixed by heat ray because of different spectral characteristics can be fused sufficiently, and instant heating fixing for color toner having a function of a soft roller or quick start fixing with shorter heating time is possible.

Another object of the invention is to provide a color image forming apparatus wherein the problems stated above are solved, color toner images superposed on a transfer material having a thick toner layer which is difficult to be fixed by heat ray because of different spectral characteristics can be fused sufficiently, and instant heating fixing for color toner images having a function of a soft roller or quick start fixing with shorter heating time is possible.

The objects stated above can be achieved by the following structures.

A color image forming apparatus comprises:

toner image forming means for forming a color toner image on a transfer sheet; and a pair of cylindrical fixing rollers for nipping the transfer sheet bearing the color toner image formed by the toner image forming means therebetween and for fixing the color toner image on the transfer sheet;

at least one of the pair of cylindrical fixing rollers comprising, heat ray irradiating means, a cylindrical light transmitting base member at an inside of which the heat ray irradiating means is provided, an elastic layer provided on the cylindrical light transmitting base member, and a heat ray absorbing layer provided on the cylindrical light transmitting base member and for absorbing and substantially shutting the heat ray passing the cylindrical light transmitting base member.

A fixing roller for fixing a color toner image, comprises:

a cylindrical light transmitting base member at an inside of which a heat ray irradiating means can be provided;

an elastic layer provided on the cylindrical light transmitting base member, and a heat ray absorbing layer provided on the cylindrical light transmitting base member and for absorbing and substantially shutting the heat ray passing the cylindrical light transmitting base member.

Further, the objects stated above can be achieved by the following preferable structures.

A color-toner-use fixing unit for fixing toner images formed on a transfer material on that transfer material through heating and pressurization, wherein there is provided a roll-shaped rotary member for heat ray fixing which is equipped with a cylindrical light transmitting base body in which a heat ray irradiating means which emits heat ray is arranged, a heat ray absorbing layer which is provided on the outer side of the light transmitting base body and absorbs almost 100% of heat ray passing through the light transmitting base body, and with elastic layer.

A color image forming apparatus for forming a color toner image on an image forming body to transfer the color toner image onto a transfer material and for fixing the color toner image formed on the transfer material through heating and pressurization, wherein there is provided a roll-shaped rotary member for heat ray fixing having elasticity which is equipped with a cylindrical light transmitting base body in which a heat ray irradiating means which emits heat ray is arranged, a heat ray absorbing layer which is provided on the outer side of the light transmitting base body and absorbs almost 100% of heat ray passing through the light transmitting base body, and with elastic layer, and thereby, the color toner image on the transfer material is fixed.

In the fixing unit stated above, it is preferable that an elastic layer, a heat ray absorbing layer and a heat conduction layer having a thickness of 10–1000 $\mu$m are provided on the outer side of the light transmitting base body in this order.

In the fixing unit stated above, it is preferable that a heat ray absorbing layer having density distribution is provided on the outer side of the light transmitting base body.

In the fixing unit stated above, it is preferable that the relation of $0.05 \leqq t/\phi \leqq 0.20$ is satisfied when $\phi$ represents an outside diameter of the cylindrical light transmitting base body and t represents a thickness.

In the fixing unit stated above, it is preferable that fine particles giving transmitting property to heat ray are mixed in the heat ray absorbing layer or in an inner layer which is adjacent to the heat ray absorbing layer.

DETAILED DESCRIPTION OF THE PREFERRED EMBODIMENT

Figure 1:
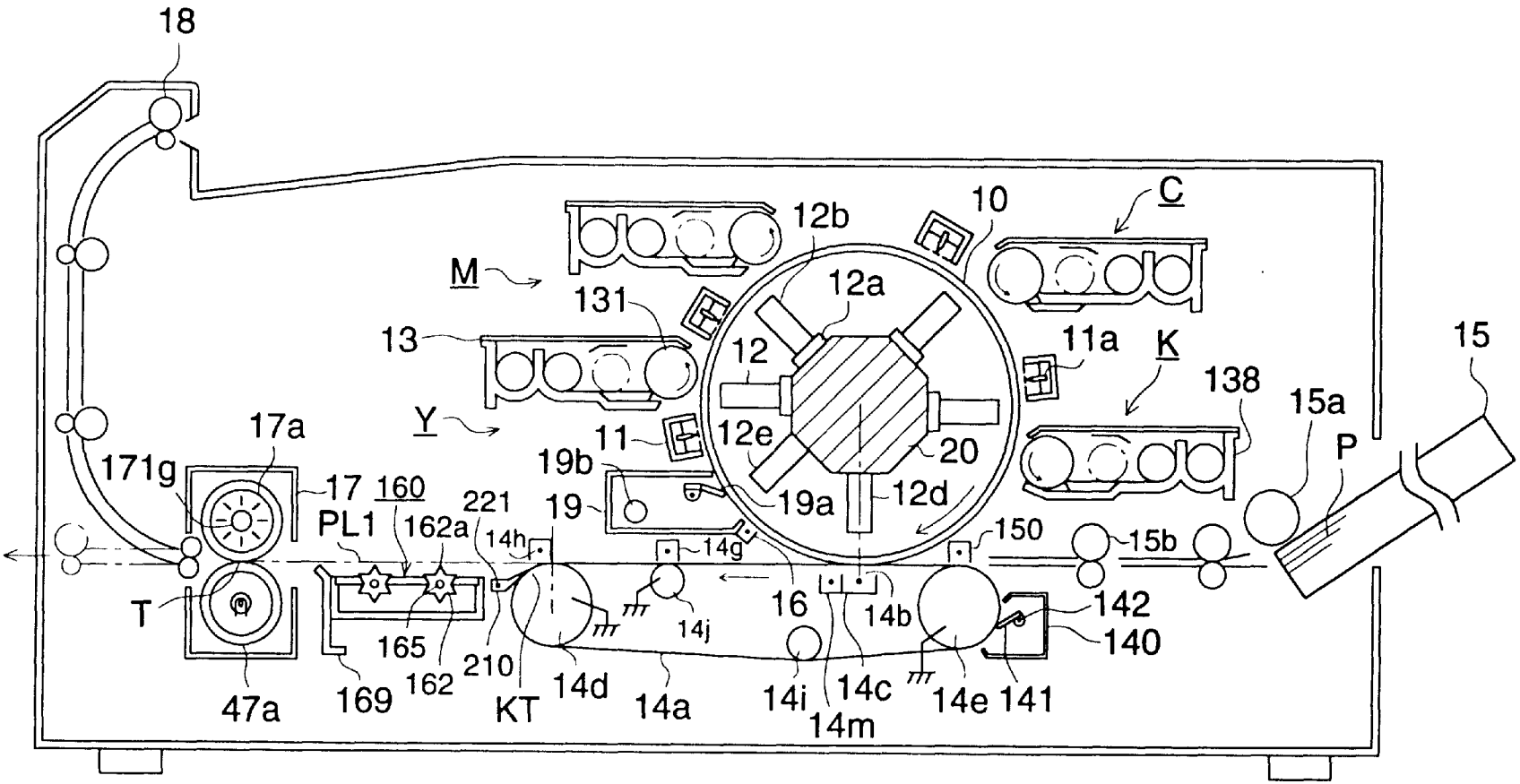
FIG. 1 is a sectional structure diagram of a color image forming apparatus showing an embodiment of an image forming apparatus employing the fixing unit related to the invention.
Figure 2:
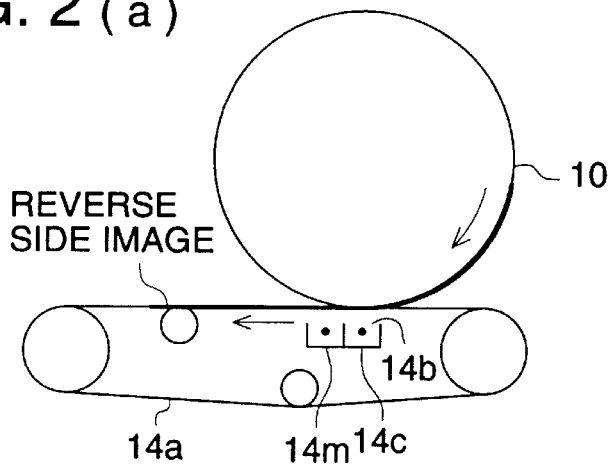
FIGS. 2(*a*) to 2(*c*) are diagrams showing how a toner image is formed in the image forming apparatus in FIG. 1.
Figure 2:
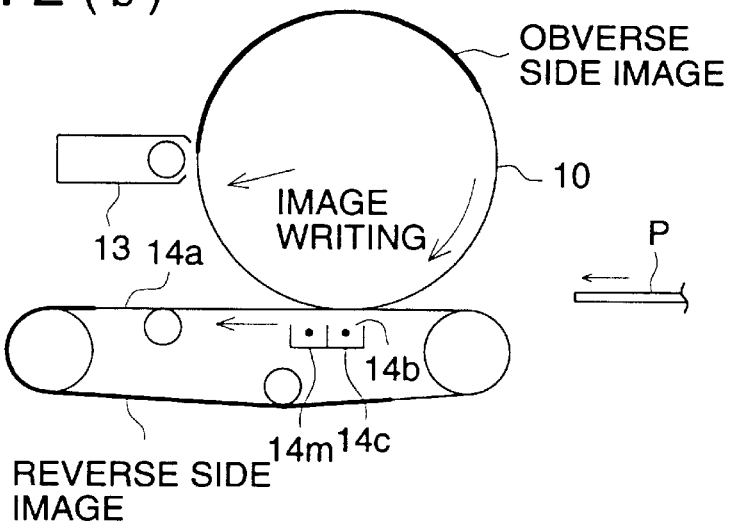
Figure 2:
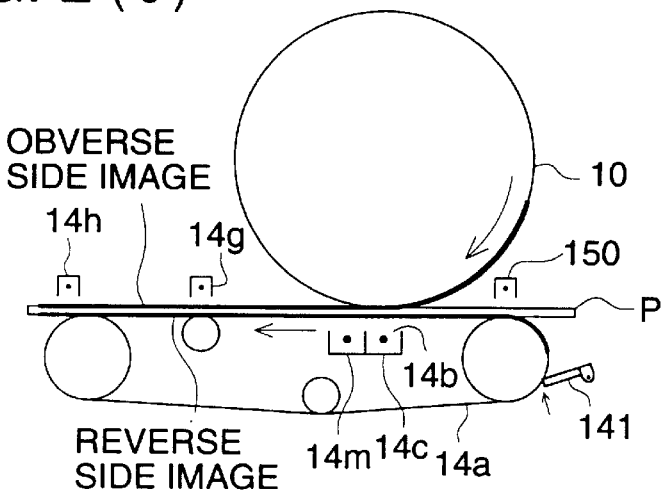
Figure 3:
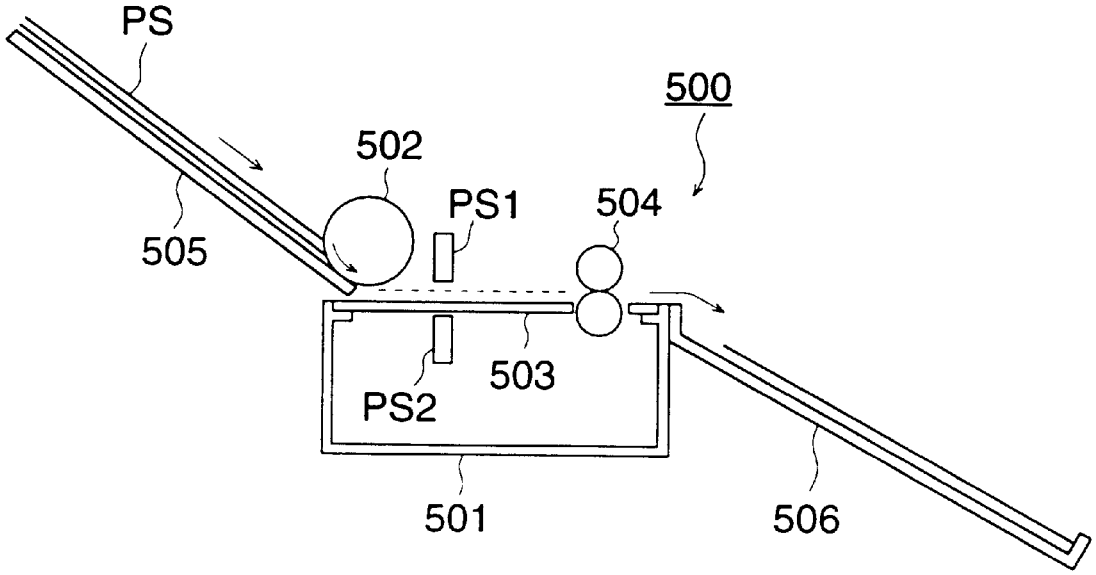
FIG. 3 is a diagram showing an example of an original image reading apparatus.
Figure 4:
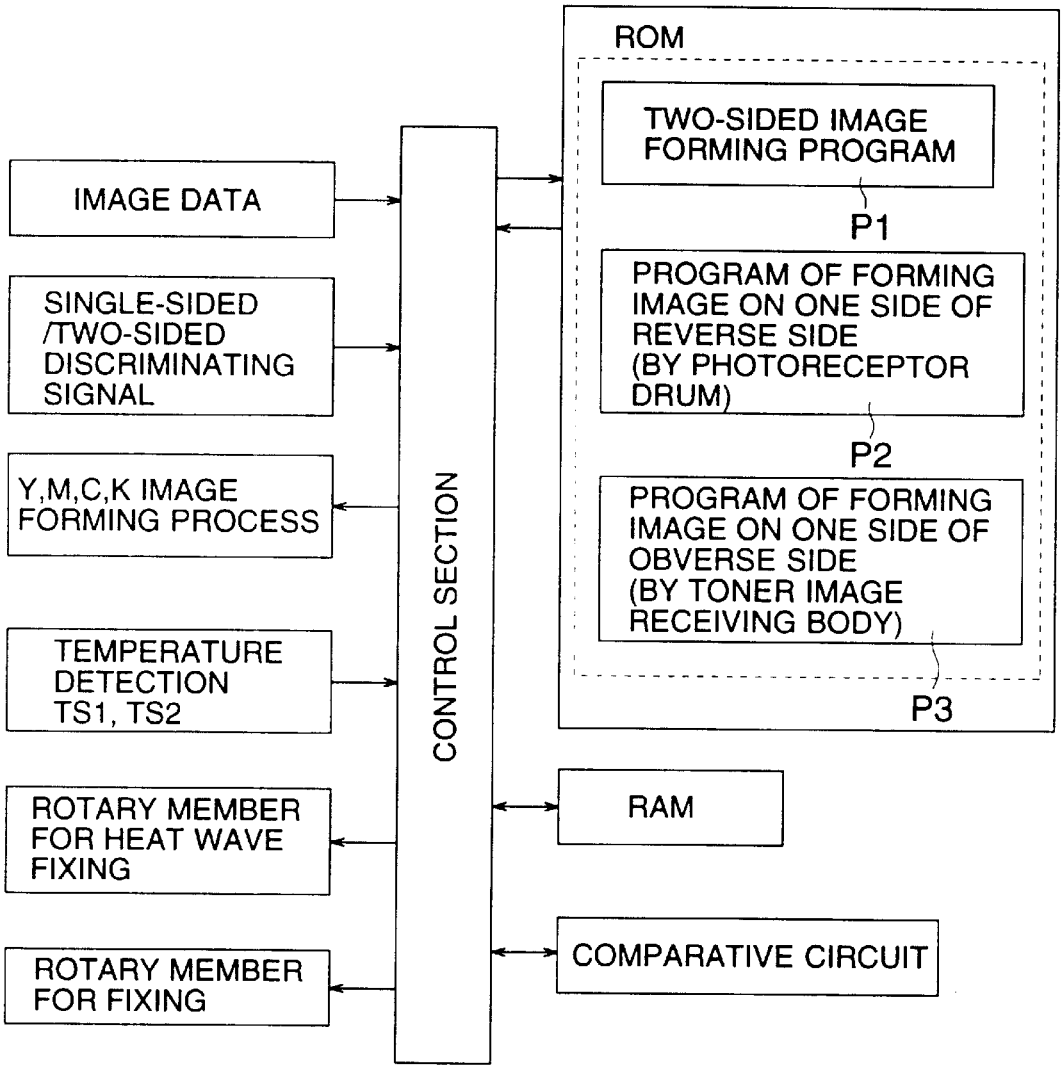
FIG. 4 is a block diagram of a control circuit of an image forming apparatus.
Figures 6A, 6B, 6C:
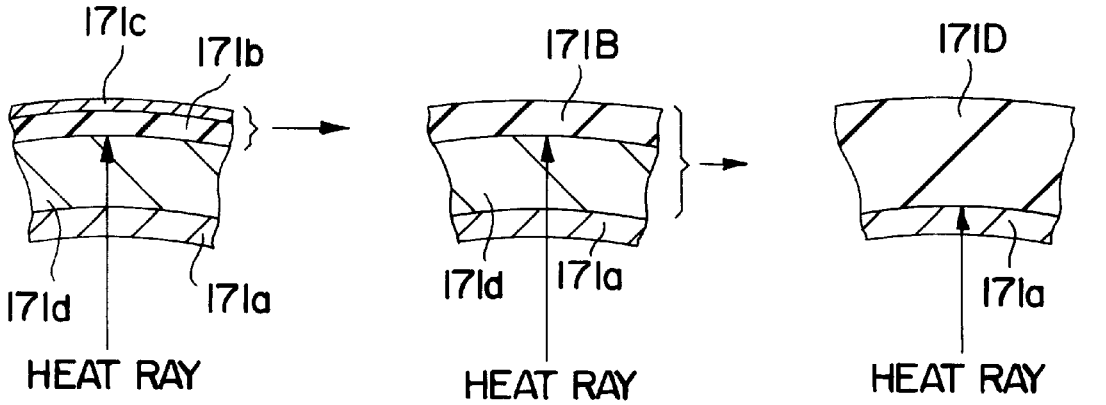
FIGS. 6(*a*) to 6(*c*) are enlarged section structure diagram of the first example of a roll-shaped rotary member for heat ray fixing.
Figure 7:
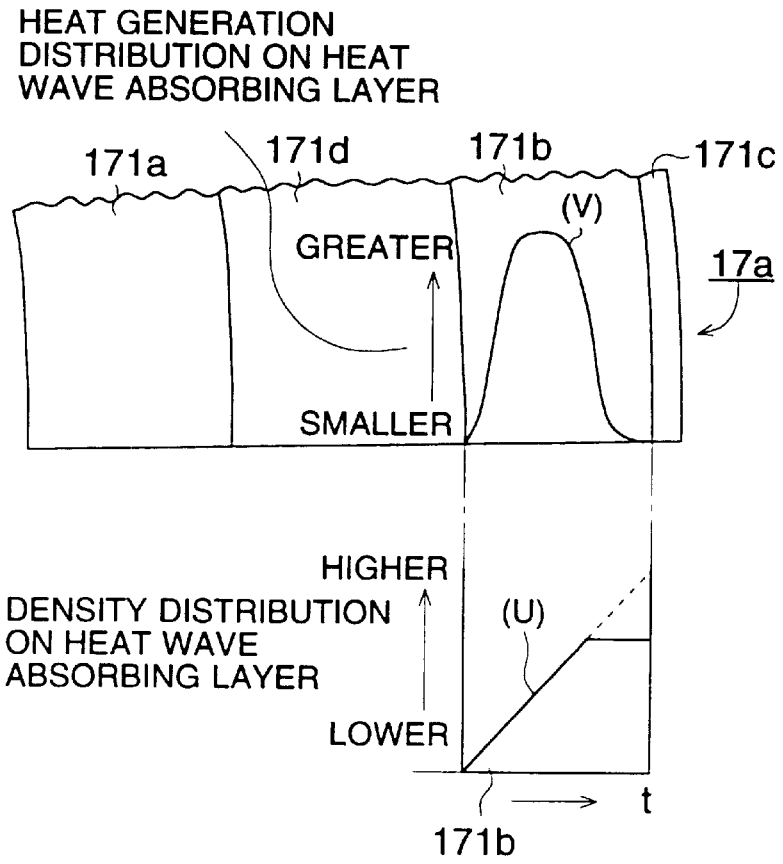
FIG. 7 is a diagram showing density distribution of a heat ray absorbing layer of a roll-shaped rotary member for heat ray fixing.
Figure 8:
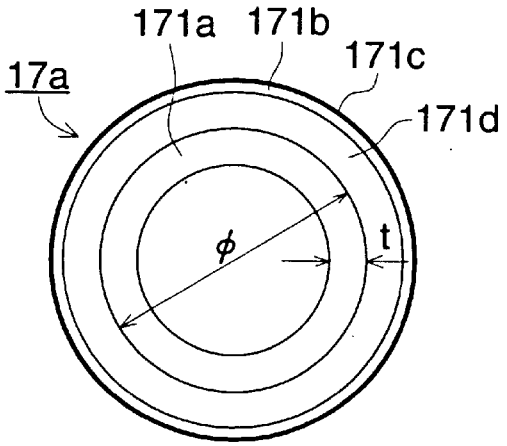
FIG. 8 is a diagram showing an outside diameter and a thickness of a light transmitting base body of a roll-shaped rotary member for heat ray fixing.
Figure 9:
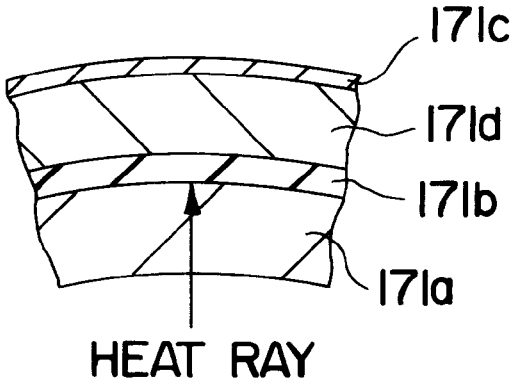
FIG. 9 is an enlarged section structure diagram of an variation of the rotary member for heat ray fixing on the upper side in FIG. 3.

There will be explained, referring to FIGS. 1–4, an image forming process and each mechanism in an embodiment of a fixing unit and an image forming apparatus using the same all related to the invention. FIG. 1 is a longitudinal section of a color image forming apparatus showing an embodiment of an image forming apparatus employing the fixing unit related to the invention, FIG. 2 is a diagram showing how a toner image is formed in the image forming apparatus shown in FIG. 1 in which FIG. 2(A) is a diagram showing how a toner image is formed when transferring a reverse side image formed on an image forming body onto an intermediate transfer body, FIG. 2(B) is a diagram showing how a toner image is formed when forming an obverse side image on an image forming body in synchronization with the reverse side image on the intermediate transfer body, and FIG. 2(C) is a diagram showing an example wherein images for both sides are formed on a transfer material. FIG. 3 is a diagram showing an example of an original image reading means, FIG. 4 is a control circuit block diagram of an image forming apparatus, and FIG. 5 an illustration showing the structure of the first example of a fixing unit. FIG. 6 shows an enlarged sectional structure diagram of the first, second, third and fourth examples of a roll-shaped heat ray fixing rotary member, FIG. 7 is a diagram showing density distribution on a heat ray absorbing layer in each of the first and second example of a roll-shaped heat ray fixing rotary member, FIG. 8 is a diagram showing density distribution on a combined-use layer of the third and fourth of a roll-shaped heat ray fixing rotary member, and FIG. 9 is a diagram showing an outside diameter and a thickness of a light-transmitting base in each of the first and second examples a roll-shaped heat ray fixing rotary member.

As shown in FIGS. 3 and 4, original image reading apparatus 500 serving as an original image reading means is composed of linear original image reading sensors PS1 and PS2 which are provided to embrace reading apparatus main body 501, original housing tray 505 for housing original PS, original feed-out roller 502, transparent plate 503, original conveyance roller 504, original delivery tray 506 and transparent plate 503 and read an original image from the top and from the bottom, and it is connected to a control section through signal lines incorporated in an outer equipment or a color image forming apparatus which will be explained below.

When original PS fed out by original feed-out roller 502 passes through transparent plate 503, original image reading sensors PS1 and PS2 provided vertically with transparent plate 503 between judge whether the original PS is a single-sided original or a two-sided original (single-sided, two-sided judgment), and read image data of the original PS.

Though one set of vertical sensors conduct judgment between a single-sided original and a two-sided original and read image data in the present embodiment, plural sensors corresponding respectively to image data reading and judgment between a single-sided original and a two-sided original may also be provided, and, for example, image data reading may be conducted after judgment between a single-sided original and a two-sided original, by using a plurality of corresponding sensors. Image data of a bundle of originals PS are read by original image reading sensor PS1 or PS2 and are stored in RAM through the control section.

When an original is judged to be a two-sided original in the manner stated above, image data of original PS are read by an original image reading means shown in FIG. 3, then, two-sided image forming program P1 stored in ROM shown in FIG. 4 is read into the RAM through the control section, and the two-sided image forming program P1 id executed by the control section, and thus, the image forming process is conducted.

In FIG. 1 and FIG. 2, the numeral 10 represents a photoreceptor drum which is an image forming body, 11 represents a scorotron charger which is a charging means for each color, 12 represents an exposure optical system which is an image writing means for each color, 13 represents a developing unit which is a developing means for each color, 14*a* represents an intermediate transfer belt which is an intermediate transfer body, 14*c* represents a transfer unit representing the first and second transfer means, 14*g* represents a reverse side transfer unit which is the third transfer means, 14*m* is a neutralizer which is a neutralizing means, 150 represents a sheet charger which is a charging means for a transfer material, 14*h* represents a sheet separation AC neutralizer which is a transfer material separating means, 160 represents a conveyance section having therein separation claw 210 representing a claw member and spurred wheel 162 representing a spur member, 169 represents a entrance guide plate which is an entrance guide member, and the numeral 17 represents a fixing unit of the first example.

The photoreceptor drum 10 representing an image forming body is one wherein a transparent conductive layer and a photosensitive layer (which is also called a photoconductive layer) such as an a—Si layer or an organic photosensitive layer (OPC) are formed on the external circumferential surface of a cylindrical base body which is made of transparent material such as optical glass or transparent acrylic resin, and it is rotated the arrowed clockwise direction in FIG. 1 with its conductive layer being grounded.

With regard to the scorotron charger 11 representing a charging means for each color, the exposure optical system 12 representing an image writing means for each color and the developing unit 13 representing a developing means for each color, four sets of them are provided for the image forming process for each color of yellow Y), magenta (M), cyan (C) and black (K), and they are arranged in the order of YMCK in the arrowed rotating direction of photoreceptor drum 10.

The scorotron charger 11 representing a charging means for each color having therein a control grid kept at each prescribed voltage and discharging electrode 11*a* composed, for example, of a serrate electrode is mounted to face the photosensitive layer of the photoreceptor drum 10, and it conducts charging operation (negative charging in the present embodiment) through corona discharging having the same polarity as toner to give uniform voltage the photoreceptor drum 10. As discharging electrode 11*a,* it is also possible to use a wire electrode and an asicular electrode.

The exposure optical system 12 representing an image writing means for each color is arranged in the photoreceptor drum 10 in a manner that the exposure position on the photoreceptor drum 10 is at the downstream side of the aforesaid scorotron charger 11 for each color in the rotation direction of the photoreceptor drum 10. Each exposure optical system 12 is an exposure unit composed of linear exposure elements 12*a* wherein plural LEDs (light emitting diodes) serving as a light emitting element for imagewise exposure light are arranged in the main scanning direction that is in parallel with a dram axis, light-converging light transmitter (trade name: SELFOC lens array) 12*b* serving as an image forming element, and an unillustrated lens holder, and it is mounted on holding member 20. on the holding member 20, there are mounted transfer-overlapping exposure unit 12*d* and uniform exposure unit 12*e,* in addition to exposure optical system 1 for each color, and they are integrated to be housed inside the transparent base body of the photoreceptor drum 10. The exposure optical system 12 for each color conducts imagewise exposure on the reverse side of a photosensitive layer of the photoreceptor drum 10 in accordance with image data for each color obtained by a separate image reading apparatus through its reading and stored in a memory, to form an electrostatic latent image on the photoreceptor drum 10. In addition to LED, it is also possible to use, as exposure elements 12*a,* the exposure elements wherein plural light emitting elements such as FL (phosphor emission), EL (electroluminescence), and PL (plasma discharging) are arranged in an array form. An emission wavelength of an imagewise exposure light emitting element used ordinarily is 780–900 nm which is highly transmitted through toner of Y, M and C. However, in the present embodiment wherein imagewise exposure is conducted on the reverse side, a wavelength 400–780 nm which are less transmitted through color toner and are shorter than the foregoing can also be used. Most of imagewise exposure light is absorbed in the photosensitive layer.

The developing unit 13 representing a developing means for each color is composed of developing sleeve 131 which keeps a prescribed clearance from the circumferential surface of the photoreceptor drum 10, rotates in the same direction as that of the photoreceptor drum 10, and is made of a cylindrical non-magnetic stainless or aluminum material having a thickness of 0.5–1.0 mm and outside diameter of 15–25, for example, and of developing casing 138 in which one-component or two-component developing agents for yellow (Y), magenta (M), cyan (C) and black (K) are housed. Each developing unit 13 is kept to be away from the photoreceptor drum 10, on a non-contact basis, with a prescribed clearance of 100–500 $\mu$m, for example, and it conducts reversal development to form a toner image on the photoreceptor drum 10 when a developing bias wherein DC voltage and AC voltage are superposed is impressed on the developing sleeve 131.

The intermediate transfer belt 14A which is an intermediate transfer body is an endless belt having the volume resistivity of $10^{10}$–$10^{16}$ Ω·cm, preferably of $10^{12}$–$10^{15}$ Ω·cm, and for example, it is a seamless belt of two-layer structure wherein fluorine coating with a thickness of 5–50 $\mu$m is preferably provided as a toner filming preventive layer on the outside of semi-conductive film base body with a thickness of 0.1–1.0 mm in which conductive materials are dispersed in engineering plastic such as, for example, denaturated polyimide, thermosetting polyimide, ethylenetetrafluoroethylene copolymer, polyfluorovinylidene, and nylon alloy. In addition to the foregoing, it is also possible to use, as a base body of the belt, a semi-conductive rubber belt having a thickness of 0.5–2.0 mm wherein conductive materials are dispersed in silicone rubber or urethane rubber. The intermediate transfer belt 14*a* is trained about driving roller 14*d* representing a roller member, grounding roller 14*j,* driven roller 14*e* and tension roller 14*i* in a way that these rollers are inscribed in the belt, and it is rotated in the counterclockwise direction shown with an arrow in FIG. 1. The driven roller 14*e,* grounding roller 14*j* and driving roller 14*d* are rotated fixedly, while the tension roller 14*i* is supported movably by elastic force of an unillustrated spring to be rotated. The driving roller 14*d* is driven by an unillustrated driving motor to be rotated, and it drives intermediate transfer belt 14*a* to rotate it. The grounding roller 14*j,* driven roller 14*e* and tension roller 14*i* are driven by rotation of the intermediate transfer belt 14*a* to be rotated. Slackness of the intermediate transfer belt 14*a* caused in the course of its rotation is removed by the tension roller 14*i.* Recording sheet P representing a transfer material is supplied to the position where the intermediate transfer belt 14*a* is trained about the driven roller 14*e,* and the recording sheet P is conveyed by the intermediate transfer belt 14*a*. The recording sheet P is separated from the intermediate transfer belt 14*a* at the curved portion KT on the end portion of the intermediate transfer belt 14*a* trained about the driving roller 14*d* on the part of fixing unit 17.

The transfer unit 14*c* representing the first and second transfer means is a corona discharger provided to face the photoreceptor drum 10 with the intermediate transfer belt 14*a* between, and transfer area 14*b* is formed between the intermediate transfer belt 14*a* and the photoreceptor drum 10. DC voltage having polarity (positive polarity in the present embodiment) opposite to that of toner is impressed on the transfer unit 14*c*, and thereby a toner image on the photoreceptor drum 10 is transferred onto the intermediate transfer belt 14*a* or on the surface of recording sheet P representing a transfer material.

The reverse side transfer unit 14*g* which is the third transfer means is preferably structured with a corona discharger, and is provided to face the conductive grounding roller 14*j* which is grounded with the intermediate transfer belt 14*a* between, and the reverse side transfer unit 14*g* transfers a toner image on the intermediate transfer belt 14*a* onto the reverse side of the recording sheet P when DC voltage having polarity opposite to that of toner (positive polarity in the present embodiment) is impressed on it.

The neutralizer 14*m* which is a neutralizing means is preferably composed of a corona discharging unit and is provided to be in parallel with transfer unit 14*c* on the downstream side of the transfer unit 14*c* representing the first and second transfer means, and when it is impressed with AC voltage which is superposed on DC voltage and has polarity which is the same as or opposite to that of toner, it neutralizes electric charges on intermediate transfer belt 14*a* charged electrically by voltage impression on transfer unit 14*c*.

The sheet charging unit 150 representing a charging means for a transfer material is preferably structured with a corona discharging unit and is provided to face driven roller 14*e* through intermediate transfer belt 14*a*, and when it is impressed with DC voltage having polarity identical to that of toner (negative polarity in the present embodiment), it charges recording sheet P so that it may be attracted to intermediate transfer belt 14*a*. As sheet charging unit 150, it is also possible to use a sheet charging brush or a sheet charging roller which can be brought into contact with or can be separated from the intermediate transfer belt 14*a*, in addition to the corona discharging unit.

The sheet separation AC neutralizer 14*h* which is a transfer material separating means is preferably structured with a corona discharging unit and is provided to face conductive driving roller 14*d* which is grounded, at need, on the edge portion of intermediate transfer belt 14*a* on the part of fixing unit 17 through the intermediate transfer belt 14*a*, and when it is impressed, at need, with AC voltage superposed on DC voltage having polarity identical to or opposite to that of toner, it neutralizes recording sheet P conveyed by the intermediate transfer belt 14*a* to separate the recording sheet P from the spurred wheel.

The conveyance section 160 has therein separation claw 210 representing a claw member and spurred wheel 162 representing a spurred wheel member, and is provided between curved portion KT on the edge portion of intermediate transfer belt 14*a* on the part of fixing unit 17 and the fixing unit 17. The conveyance section 160 prevents that heat from the fixing unit 17 deforms the intermediate transfer belt 14*a*, causes a toner image carried by the intermediate transfer belt 14a to be fused slightly and thereby to be difficult to be transferred, and causes toner to be stuck to the intermediate transfer belt 14*a*.

The separation claw 210 representing a claw member is provided to be fixed on supporting shaft 221 to be close to curved portion KT on the intermediate transfer belt 14*a* to be away from the intermediate transfer belt by a prescribed distance, preferably by a distance of 0.1–2.0 mm, and it makes the leading edge of recording sheet P which is bent toward the intermediate transfer belt 14*a* to tends to be conveyed to touch so that the recording sheet P may be assisted to be separated, when the recording sheet P is separated from the intermediate transfer belt 14*a*.

The spurred wheel 162 representing a spurred wheel member has on its circumferential surface plural projected sections 162*a*, and is provided so that it can rotate freely on the center of rotation supporting shaft 165. The spurred wheel 162 guides the reverse side of recording sheet P when it is conveyed, and it prevents disturbance of toner images on the reverse side of recording sheet P which has toner images on its both sides, and conveys the recording sheet P to the fixing unit 17 stably while making the direction of the recording sheet P to enter the fixing unit 17 to be constant.

The separation claw 210 and the spurred wheel 162 are arranged to be in contact with or to be close to transfer material conveyance plane PL1 (hereinafter referred to as transfer material conveyance plane PL1) which passes through curved portion KT of the intermediate transfer belt 14*a* and through an entrance portion (entry portion) for a transfer material to advance to nipping section T of fixing unit 17, on the side opposite to that for photoreceptor drum 10 with respect to the transfer material conveyance plane PL1. It is also possible to provide spurred wheels 162 representing a spurred wheel member on both sides of the transfer material conveyance plane PL1.

The entrance guide plate 169 which is an entrance guide member is arranged to be in contact with or to be close to the transfer material conveyance plane PL1 on the side opposite to that for photoreceptor drum 10 with respect to the transfer material conveyance plane PL1, and its tip portion guides recording sheet P to cause the leading edge of the recording sheet P to enter nipping section T of fixing unit 17 so that creases in the course of fixing operation may be prevented.

The fixing unit 17 in the first example is structured with first heat ray fixing roller 17*a* representing a roll-shaped rotary member for heat ray fixing on the upper side (obverse side) for fixing toner images of obverse side images (images on the upper side) and with first fixing roller 47*a* representing a roll-shaped rotary member for fixing on the lower side (reverse side) for fixing toner images of reverse side images (images on the lower side), and it nips recording sheet P at nipping section T having a width of about 2–10 mm formed between first heat ray fixing roller 17*a* and first fixing roller 47*a*, and then applies heat and pressure to fix toner images on the recording sheet P. Inside the first heat ray fixing roller 17*a*, there is provided heat ray irradiation member 171*g* representing a heat ray irradiation means wherein a halogen lamp or a xenon lamp which mainly emits heat ray such as infrared rays or far infrared radiation is used.

Next, an image forming process will be explained.

After an unillustrated motor for driving a photoreceptor starts operating at the start of image recording, photoreceptor drum 10 is rotated in the clockwise direction shown with an arrow in FIG. 1, and simultaneously with this, scorotron charging unit 11 for yellow (Y) starts applying voltage on photoreceptor drum 10.

After the photoreceptor drum 10 is given voltage, image writing by electric signals corresponding to the first color signal, namely to image data for Y is started by exposure optical system 12 for Y, and thereby, electrostatic latent images corresponding to images for Y of original images are formed on the obverse side of the photoreceptor drum 10.

The latent image mentioned above is subjected to reversal development conducted by developing unit 13 for Y under the non-contact condition, and a toner image for yellow (Y) is formed on the photoreceptor drum 10.

Scorotron charging unit 11 for magenta (M) applies voltage on photoreceptor drum 10 through the toner image for Y, then, image writing by electric signals corresponding to the second color signals, namely to image data for M is conducted by exposure optical system 12 for M, and a toner image for magenta (M) is formed to be superposed on the toner image for yellow (Y) through reversal development on a non-contact basis conducted by developing unit 13 for M.

Through the same process, a toner image for cyan (C) corresponding to the third color signals is formed to be superposed by scorotron charger 11 for cyan (C), exposure optical system 12 for C and developing unit 13 for C. Further, on these toner images, there is formed a toner image for black (K) corresponding to the fourth color signals by scorotron charger 11 for black (K), exposure optical system 12 for K and developing unit 13 for K. Thus, within on turn of the photoreceptor drum 10, superposed color toner images respectively for yellow (Y), magenta (M), cyan (C) and black (K) are formed on the circumferential surface of the photoreceptor drum 10 (toner image forming means).

Image writing on the photosensitive layer of the photoreceptor drum 10 conducted by exposure optical system 12 for each of Y, M, C and K is carried out from the inside of the drum through the light-transmitting base body mentioned above. Therefore, writing of images corresponding to each of color signals for the second, third and fourth color signals can be conducted without being affected by the preceding toner image, thus, electrostatic latent images which are the same in terms of quality as the image corresponding to the first color signal can be formed.

The superposed color toner images formed by the aforesaid image forming process on the photoreceptor drum 10 representing an image forming body, to be reverse side images are collectively transferred (primary transfer) onto intermediate transfer belt 14*a* representing an intermediate transfer body by transfer unit 14*c* representing the first transfer means at transfer area 14*b* (FIG. 2(A)). In this case, it is also possible to arrange so that uniform exposure may be conducted by transfer-overlapping exposure unit 12*d* provided inside the photoreceptor drum 10, so that satisfactory transfer may be conducted.

Toner remaining on the circumferential surface of the photoreceptor drum 10 after transferring is neutralized by photoreceptor drum AC neutralizing unit 16, and then advances to cleaning unit 19 representing an image forming body cleaning means where it is removed by cleaning blade 19*a* made of rubber material that is in contact with the photoreceptor drum 10 to be collected by screw 19*b* into an unillustrated waste toner container. Further, on the circumferential surface of the photoreceptor drum 10, hysteresis on the photoreceptor drum 10 remaining from the previous image forming can be erased through exposure conducted by uniform exposure unit 12*e* before charging.

Electric charges on the intermediate transfer belt 14*a* generated through charging by transfer unit 14*c* can be neutralized by neutralizing unit 14*m* representing a neutralizing means provided to be in parallel with the transfer unit 14*c*.

After the superposed color toner image (second toner image) which is to be a reverse side image is formed on intermediate transfer belt 14*a* in the method stated above, a superposed color toner image (first toner image) which is to be an obverse side image is formed, in succession, on the photoreceptor drum 10, in the same manner as in the aforesaid color image forming process (FIG. 2(B)). In this case, the obverse side image formed on the photoreceptor drum 10 is changed in terms of image data so that the obverse side image may be a mirror image for the reverse side image formed on the photoreceptor drum 10.

With formation of an obverse side image on the photoreceptor drum 10, recording sheet P representing a transfer material is fed out of sheet-feeding cassette 15 representing a transfer material housing means by feed-out roller 15*a*, then is conveyed to timing roller 15*b* representing a transfer material feeding means, and is driven by the timing roller 15*b* to be fed to transfer area 14*b*, with a color toner image of the obverse side image representing the first toner image formed on the photoreceptor drum 10 and a color toner image of the reverse side image representing the second toner image carried on the intermediate transfer belt 14*a* photoreceptor drum 10 both being synchronized with each other. In this case, the recording sheet P to be fed is charged by sheet charging unit 150 representing a transfer material charging means provided on the obverse side of the recording sheet P, to have polarity identical to that of toner, and thereby is attracted to the intermediate transfer belt 14*a* to be fed to the transfer area 14*b*. Sheet charging to polarity identical to that of toner prevents that the sheet attracts a toner image on the intermediate transfer belt 14*a* and a toner image on the intermediate transfer belt 14*a* and a toner image on the photoreceptor drum 10, and prevents disturbance of toner images.

In the transfer area 14*b*, the obverse side image on the photoreceptor drum 10 is transferred (secondary transfer) collectively onto the obverse side of the recording sheet P by transfer unit 14*c* representing the second transfer means which is impressed with voltage having polarity opposite to that of toner (positive polarity in the present embodiment). In this case, the reverse side image on the intermediate transfer belt 14*a* remains on the intermediate transfer belt 14*a* without being transferred onto recording sheet P. For the purpose of satisfactory transfer in the case of the secondary transfer by transfer unit 14*c* representing the second transfer means, it is also possible to arrange so that uniform exposure may be conducted by transfer-overlapping exposure unit 12*d* employing, for example, a light emitting diode, which is provided inside the photoreceptor drum 10 to face the transfer area 14*b*. On the other hand, electric charges provided on the intermediate transfer belt 14*a* through charging by transfer unit 14*c* are neutralized by neutralizing unit 14*m*.

Recording sheet P having on its obverse side a transferred color toner image is conveyed to reverse side transfer unit 14*g* representing the third transfer means on which voltage having polarity opposite to that of toner (positive polarity in the present embodiment) is impressed, and reverse side images on the circumferential surface of the reverse side transfer unit 14*g* are collectively transferred (tertiary transfer) onto the reverse side of recording sheet P (FIG. 2(C)).

The recording sheet P having on its both sides color toner images thus formed is separated from the intermediate transfer belt 14*a* by curvature of curved portion KT of the intermediate transfer belt 14*a*, neutralizing operations of sheet separation AC neutralizing unit 14*h* representing a transfer material separating means provided, at need, at the edge portion of the intermediate transfer belt 14*a,* and by separation claw 210 which is provided on conveyance section 160 to be away by a prescribed distance from the intermediate transfer belt 14*a,* and is conveyed to fixing unit 17 stably through spurred wheel 162 and entrance guide plate 169 provided on conveyance section 160. A leading edge portion of the recording sheet P is fed into nipping section T of the fixing unit 17 by the entrance guide plate 169, and when heat and pressure are applied to the recording sheet P at the nipping section T between first heat ray fixing roller 17*a* which is arranged at the upper side to fix toner images of the obverse side image (images on the upper side) and first fixing roller 47*a* which is arranged at the lower side to fix toner images of the reverse side image (images on the lower side), the toner images on the recording sheet P are fixed. The recording sheet P having on its both sides images thus formed is reversed with respect to its obverse side and reverse side, and is conveyed to be ejected by sheet ejection roller 18 on a tray provided outside an apparatus. As is shown by one-dot chain line in FIG. 1, it is also possible to provide an unillustrated switching member at an exit of fixing unit 17 and to eject the recording sheet to a tray outside an apparatus without reversing the recording sheet with respect to its obverse side and reverse side.

Toner remaining on the circumferential surface of the intermediate transfer belt 14*a* after transfer is removed by intermediate transfer material cleaning unit 140 which is provided to face driven roller 14*e* with the intermediate transfer belt 14*a* between and represents an intermediate transfer material cleaning means having intermediate transfer material cleaning blade 141 which can be swung around supporting shaft 142 serving as a fulcrum to touch and leave the intermediate transfer belt 14*a*.

Toner remaining on the circumferential surface of the intermediate transfer belt 14*a* after transfer is neutralized by photoreceptor drum AC neutralizing unit 16 and then is removed by cleaning unit 19, thus, hysteresis on the photoreceptor drum 10 remaining from the previous image forming is erased by uniform exposure unit 12*e* before charging, and a following image forming cycle is started.

When the aforesaid method is used, superposed color toner images are transferred collectively. Therefore, color doubling of color images on the intermediate transfer belt 14*a,* and toner scattering and scrubbing of them are hardly caused, resulting in excellent two-sided color image forming which has less image deterioration.

In the original image reading apparatus 500 stated above, when copying image data of original PS read by an original image reading means shown in FIG. 3 as a single-sided image of the obverse side only by the photoreceptor drum 10, in the case of judgment to be a single-sided image or a two-sided image, single-sided image forming program P2 on the obverse side by photoreceptor drum 10 representing an image forming body stored in ROM shown in FIG. 4 is read into RAM through a control section, and an image forming process of the obverse side only by the photoreceptor drum 10 explained in FIG. 1 is conducted continuously.

When copying image data of original PS read by an original image reading means shown in FIG. 3 as a single-sided image of the reverse side only by the intermediate transfer belt 14, in the case of judgment to be a single-sided image or a two-sided image, single-sided image forming program P3 on the reverse side by the intermediate transfer belt 14*a* representing an intermediate transfer body stored in ROM shown in FIG. 4 is read into RAM through a control section, then, single-sided image program P3 of the reverse side is executed by a control section, and an image forming process of the reverse side only by the intermediate transfer belt 14*a* explained in FIG. 1 is conducted continuously.

Figure 5:
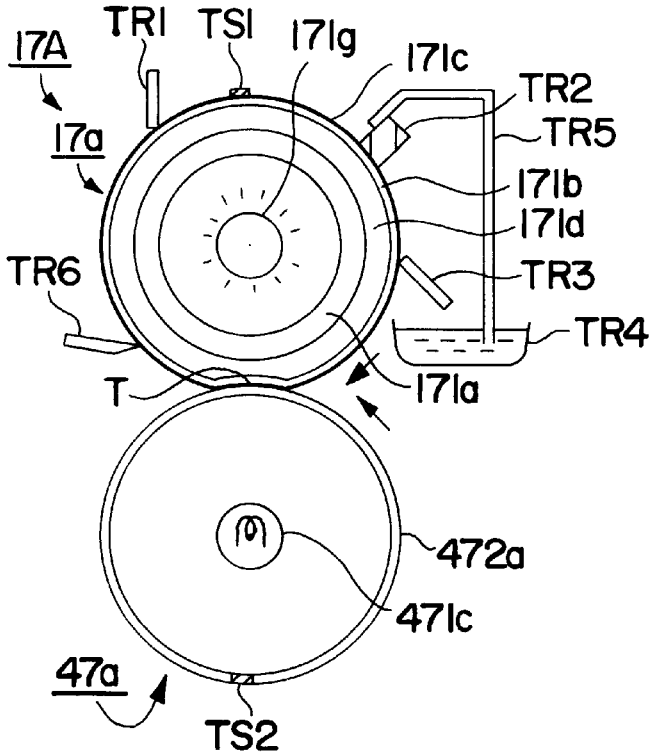
FIG. 5 is an illustration showing the structure of the first example of a color-toner-use fixing unit.

As is shown in FIG. 5, color-toner-use fixing unit 17A in the first example is composed of heat ray fixing roller 17*a* representing an elastic roll-shaped rotary member for heat ray fixing on the upper side for fixing toner images on a transfer material and fixing roller 47*a* representing a roll-shaped rotary member for fixing on the lower side, and it nips recording sheet P at nipping section T having a width of about 2–10 mm formed between the heat ray fixing roller 17*a* having elasticity and the fixing roller 47*a,* and then applies heat and pressure to fix toner images on the recording sheet P. On the heat ray fixing roller 17*a* representing a roll-shaped rotary member for heat ray fixing located on the upper side, there are provided, from a position of the nipping section T in the rotary direction of the heat ray fixing roller 17*a,* fixing separation claw TR6, fixing oil cleaning blade TR1, oil coating felt TR2 and oil quantity control blade TR3, and oil supplied to the oil coating felt TR2 from oil tank TR4 through capillary pipe TR5 is coated on the heat ray fixing roller 17*a* by the oil coating felt TR2. The fixing oil cleaning blade TR1 cleans the circumferential surface of the heat ray fixing roller 17*a* of oil staying thereon. Therefore, temperature sensor TS1 which measures temperature of the heat ray fixing roller 17*a* and will be explained later is provided on the cleaned circumferential surface of the heat ray fixing roller 17*a* between the fixing oil cleaning blade TR1 and the oil coating felt TR2. The transfer material after fixing is separated by the fixing separation claw TR6. These members are also provided on a roll-shaped rotary member for heat ray fixing explained in FIG. 8 which will be described later (not shown in FIG. 10, or may be provided on the upper and lower rotary members for heat ray fixing).

Heat ray fixing roller 17*a* representing a rotary member for heat ray fixing which fixes toner images on a transfer material is structured as a soft roller wherein cylindrical light-transmitting base body 171*a* is provided, on its outside (outer circumferential surface), with elastic layer 171*d,* heat ray absorbing layer 171*b* and releasing layer 171*c* in this order, and inside the light-transmitting base body 171*a,* there is arranged heat ray irradiating member 171*g* representing a heat ray irradiating means employing, for example, a halogen lamp or a xenon lamp which mainly emits heat rays such as infrared rays or far infrared rays. The heat ray fixing roller 17*a* representing a rotary member for heat ray fixing is structured as a highly elastic soft roller in the manner described later. Heat rays emitted from the heat ray irradiating member 171*g* are absorbed by the heat ray absorbing layer 171*b,* and thereby, there is formed a roll-shaped rotary member for heat ray fixing capable of heating instantly.

The fixing roller 47*a* representing a rotary member for fixing on the lower side is formed with cylindrical metal pipe 472*a* employing, for example, iron material or steel material (thermal conductivity: $(0.15–0.76)\times10^{-3}$ J/cm·s·K) whose outside circumferential surface is subjected to Teflon coating by a method of baking or coating, and it is structured as a hard roller wherein halogen heater 471*c* is arranged, at need, inside the metal pipe 472*a*. Fixing roller 47*a* is structured as a hard roller which has excellent thermal conductivity as stated above.

Between the soft roller on the upper side and the hard roller on the lower side, there is formed nipping section T whose upper side is convex where toner images are fixed.

The symbol TS1 is a temperature sensor employing, for example, a thermistor for temperature control mounted on the upper heat ray fixing roller 17*a,* while TS2 is a temperature sensor employing, for example, a thermistor for temperature control mounted on the lower fixing roller 47*a.*

In the structure of the heat ray fixing roller 17*a* in FIG. 6, ceramic materials such as Pyrex glass, sapphire ($Al_2O_3$), and $CaF_2$ (thermal conductivity: $(5.5–19.0)\times10^{-3}$ J/cm·s·K) which transmits heat ray such as infrared rays or far infrared rays emitted from the heat ray irradiating member and light-transmitting resins (thermal conductivity: $(2.5–3.4)\times10^{-3}$ J/cm·s·K) employing polyimide and polyamide are used for cylindrical light-transmitting base body 171*a* whose section is shown in FIG. 6(*a*). Since a wavelength of a heat ray transmitted through the light-transmitting base body 171*a* is 0.1–20 μm, and preferably is 0.3–3 μm, adjusting agents for hardness and thermal conductivity are added as a filler. However, the light-transmitting base body 171*a* may also be formed with those wherein fine particles of a metal oxide such as titanium oxide, aluminum oxide, zinc oxide, silicon oxide, magnesium oxide, or calcium carbonate having heat ray transmissivity (mainly infrared ray transmissivity or far infrared ray transmissivity) of average particle size of not more than 1 μm, preferably of not more than 0.1 μm including primary and secondary particles having a particle size of not more than ½ or ⅕ of a wavelength of heat ray are dispersed in resin binders. It is preferable to prevent light dispersion and to make light to reach the heat ray absorbing layer 171*b* that an average particle size including primary and secondary particles is not more than 1 μm, and preferably is not more than 0.1 μm. As stated above, thermal conductivity of the light-transmitting base body 171*a* is not so high.

The elastic layer 171*d* is formed with a heat-wave-transmitting rubber layer (base layer) which transmits aforesaid heat ray (mainly, infrared rays or far infrared rays), by using, for example, silicone rubber having a thickness not smaller than 0.5 mm, more preferably a thickness of 2 mm–20 mm. For the elastic layer 171*d,* there is taken a method to improve thermal conductivity by combining powder of metal oxide such as silica, alumina and magnesium oxide with base rubber (silicone rubber) as a filler, for coping with the high speed, and a rubber layer having thermal conductivity of $(1.3–1.6)\times10^{-3}$ J/cm·s·K) is preferable. When thermal conductivity is raised, rubber hardness tends to be higher in general, including an example that hardness which is normally 40 Hs is raised nearly to 60 Hs (JIS, A rubber hardness). The greater part of the elastic layer 171*d* of a rotary member for heat ray fixing is occupied by this base layer, and an amount of compression in pressurizing is determined by rubber hardness of a base layer. On an intermediate layer of the elastic layer 171*d,* there is coated fluorine rubber to thickness of 20–300 μm as an oil-resisting layer for the purpose of preventing oil swelling. As silicone rubber for the top layer of the elastic layer 171*d,* RTV (room temperature vulcanizing) or LTV (low temperature vulcanizing) which is better in terms of releasing property than HTV (high temperature vulcanizing) is covered with a thickness similar to that of the intermediate layer. Since a wavelength of a heat ray transmitted through the elastic layer 171*d* is 0.1–20 μm, and preferably is 0.3–3 μm, the elastic layer 171*d* may also be formed with those wherein fine particles of a metal oxide such as titanium oxide, aluminum oxide, zinc oxide, silicon oxide, magnesium oxide, or calcium carbonate having heat ray transmissivity (mainly infrared ray transmissivity or far infrared ray transmissivity) of average particle size of not more than 1 μm, preferably of not more than 0.1 μm including primary and secondary particles having a particle size of not more than ½ preferably not more than ⅕ of a wavelength of heat ray are dispersed, as adjusting agents for hardness and thermal conductivity, in resin binders. It is preferable to prevent light dispersion and to make light to reach the heat ray absorbing layer 171*b* that an average particle size including primary and secondary particles is not more than 1 μm, and preferably is not more than 0.1 μm. Owing to the elastic layer 171*d* thus provided, heat ray fixing roller 17*a* representing a rotary member for heat ray fixing can be structured as a soft roller having high elasticity.

With regard to heat ray absorbing layer 171*b,* heat ray absorbing member wherein powder of carbon black, graphite, black iron oxide ($Fe_3O_4$), various ferrite and their compounds, oxidized copper, cobalt oxide and Indian red ($Fe_2O_3$) is mixed with resin binders is used, and the heat ray absorbing member stated above having a thickness of 10–200 μm, preferably of 20–100 μm is formed on the outside (outer circumferential surface) of the elastic layer 171*d* through blasting or coating, so that heat ray of 90–100%, preferably of 95–100% which is mostly 100% of heat ray emitted from heat ray irradiating member 171*g* and transmitted through light-transmitting base body 171*a* and elastic layer 171*d* may be absorbed by heat ray absorbing layer 171*b,* and thereby, a rotary member for heat ray fixing capable of heating instantly may be formed. When the heat ray absorbing rate of the heat ray absorbing layer 171*b* is lower than 90% to be, for example, 20–80%, heat ray leaks, and when the heat ray fixing roller 17*a* representing a rotary member for heat ray fixing is used for monochromatic image forming by the leaked heat ray, if black toner is stuck to the surface of the specific position of the heat ray fixing roller 17*a* by filming, heat generation is caused by leaked heat ray at the black toner sticking portion, and further heat generation is caused by further absorption of heat ray at that portion, thus, heat ray absorbing layer 171*b* is damaged When used for color image forming, fixing failure or uneven fixing is caused because the absorbing rate of a color toner is generally low, and there is a difference of absorption efficiency between color toners. Therefore, the heat ray absorption rate of the heat ray absorbing layer 171*b* is made 90–100% which is mostly about 100%, preferably 95–100%. Due to this, fusion of color toner which is difficult to be fixed by heat ray because of different spectral characteristics can be conducted satisfactorily, and in color image forming in FIG. 1, in particular, fusion of superposed color toner images on a transfer material on which a toner layer is thick which is difficult to be fixed by heat ray because of different spectral characteristics can be conducted satisfactorily. When a thickness of the heat ray absorbing layer 171*b* is thin to be less than 10 μm, damage and insufficient strength of the heat ray absorbing layer 171*b* are caused by local heating caused by a thin film, although heating speed owing to absorption of heat ray on the heat ray absorbing layer 171*b* is high, while, when a thickness of the heat ray absorbing layer 171*b* is thick to be more than 20 μm, insufficient heat conduction is caused and heat capacity grows greater, making instant heating to be difficult. By making the heat ray absorbing rate of the heat ray absorbing layer 171*b* to be 90–100% corresponding mostly to 100%, or preferably to be 95–100%, and by making a thickness of the heat ray absorbing layer 171*b* to be 10–200 μm, preferably to be 20–100 μm, local heat generation on the heat ray absorbing layer 171*b* can be prevented and uniform heat generation can be carried out. Further, since the wavelength of a heat ray projected on the heat ray absorbing layer 171*b* is 0.1–20 μm, preferably is 0.3–3 μm, it is also possible to form the heat ray absorbing layer 171*b* with those wherein fine particles of metal oxide such as titanium oxide, aluminum oxide, zinc oxide, silicon oxide, magnesium oxide, or calcium carbonate having heat ray transmissivity (mainly infrared ray transmissivity or far infrared ray transmissivity) of average particle size of not more than 1 μm, preferably of not more than 0.1 μm including primary and secondary particles having a particle size of not more than ½ or ⅕ of a wavelength of heat ray are dispersed, at the rate of 5–50% by weight, in resin binders. Since the heat capacity of the heat ray absorbing layer 171*b* is made to be small in the manner stated above so that its temperature may rise quickly, it is possible to prevent problems that a temperature of heat ray fixing roller 17*a* representing a rotary member for heat ray fixing falls, resulting in occurrence of uneven fixing.

On the outer side (outer circumferential surface) of the heat ray absorbing layer 171*b,* there is provided releasing layer 171*c* which is covered with PFA (fluorine resin) tube having a thickness of 30–100 μm or is coated with fluorine resin (PFA or PTFE) coating to a thickness of 20–30 μm, to improve the property of releasing from toner (separation pattern).

As FIG. 6(*b*) shows a sectional view, a heat ray absorbing member wherein powder of carbon black, graphite, black iron oxide ($Fe_3O_4$), various ferrite and their compounds, oxidized copper, cobalt oxide and Indian red ($Fe_2O_3$) is mixed with fluorine resin (PFA or PTFE) coating serving as both binders and releasing agents to be combined, and solid type heat ray absorbing layer 171B having releasing property in which heat ray absorbing layer 171*b* and releasing layer 171*c* are integrated solidly is formed, as shown in FIG. 6(*a*), on the outer side (outer circumferential surface) of elastic layer 171*d* formed on the outer side (outer circumferential surface) of light transmitting base body 171*a,* and thereby a roll-shaped rotary member for heat ray fixing having elasticity is formed. In the same way as in the foregoing, a heat ray absorbing rate of the solid type heat ray absorbing layer 171B is made to be 90–100% deserving almost 100%, preferably to be 95–100%, so that heat ray emitted from heat ray irradiating member 171*g* and transmitted through light transmitting base body 171*a* and elastic layer 171*d* may be absorbed completely. When the heat ray absorbing rate of the solid type heat ray absorbing layer 171B is lower than 90%, or is 20–80%, for example, heat ray leaks, and when the rotary member for heat ray fixing is used for monochromatic image forming by the leaked heat ray, if black toner is stuck to the surface of the specific position of the rotary member for heat ray fixing by filming, heat generation is caused by leaked heat ray at the black toner sticking portion, and further heat generation is caused repeatedly by further absorption of heat ray at that portion, thus, the solid type heat ray absorbing layer 171B is damaged. When used for color image forming, fixing failure or uneven fixing is caused because the absorbing rate of a color toner is generally low, and there is a difference of absorption efficiency between color toners. Therefore, the heat ray absorption rate of the solid type heat ray absorbing layer 171B is made to be 90–100% which is mostly about 100%, preferably to be 95–100 so that heat ray emitted from heat ray irradiating member 171*g* and transmitted through the light transmitting base body 171*a* may be absorbed completely in the rotary member for heat ray fixing. Further, local heat generation on the solid type heat ray absorbing layer 171B can be prevented and uniform heat generation can be carried out. Further, since the wavelength of a heat ray projected on the solid type heat ray absorbing layer 171B is 0.1–20 μm, preferably is 0.3–3 μm, it is also possible to form the solid type heat ray absorbing layer 171B with those wherein fine particles of metal oxide such as titanium oxide, aluminum oxide, zinc oxide, silicon oxide, magnesium oxide, or calcium carbonate having heat ray transmissivity (mainly infrared ray transmissivity or far infrared ray transmissivity) of average particle size of not more than 1 μm, preferably of not more than 0.1 μm including primary and secondary particles having a particle size of not more than ½, preferably ⅕ of a wavelength of heat ray are dispersed in resin binders.

As FIG. 6(*c*) shows a sectional view, a heat ray absorbing member wherein powder of carbon black, graphite, black iron oxide ($Fe_3O_4$), various ferrite and their compounds, oxidized copper, cobalt oxide and Indian red ($Fe_2O_3$) is mixed with fluorine resin (PFA or PTFE) coating serving as both binders and releasing agents to be combined with silicone rubber, and solid type elastic layer 171D serving integrally as the elastic layer 171*d* and the solid type heat ray absorbing layer 171B described in FIG. 6(*b*) as a heat ray absorbing layer is formed on the outer side (outer circumferential surface) of the light transmitting base body 171*a,* and thereby a roll-shaped rotary member for heat ray fixing having elasticity is formed. In the same way as in the foregoing, a heat ray absorbing rate of the solid type heat ray absorbing layer 171D serving also as a heat ray absorbing layer is made to be 90–100% deserving almost 100%, preferably to be 95–100%, so that heat ray emitted from heat ray irradiating member 171*g* and transmitted through light transmitting base body 171*a* may be absorbed completely in the rotary member for heat ray fixing. When the heat ray absorbing rate of the solid type heat ray absorbing layer 171D is lower than about 90%, or is 20–80%, for example, heat ray leaks, and when the rotary member for heat ray fixing is used for monochromatic image forming by the leaked heat ray, if black toner is stuck to the surface of the specific position of the rotary member for heat ray fixing by filming, heat generation is caused by leaked heat ray at the black toner sticking portion, and further heat generation is caused repeatedly by further absorption of heat ray at that portion, thus, the solid type elastic layer 171D is damaged. When used for color image forming, fixing failure or uneven fixing is caused because the absorbing rate of a color toner is generally low, and there is a difference of absorption efficiency between color toners. Therefore, the heat ray absorption rate of the solid type heat ray absorbing layer 171D is made to be 90–100% which is mostly about 100%, preferably to be 95–100 so that heat ray emitted from heat ray irradiating member 171*g* and transmitted through the light transmitting base body 171*a* may be absorbed completely in the rotary member for heat ray fixing. Further, local heat generation on the solid type heat ray absorbing layer 171B can be prevented and uniform heat generation can be carried out. Further, since the wavelength of a heat ray projected on the solid type heat ray absorbing layer 171B is 0.1–20 μm, preferably is 0.3–3 μm, it is also possible to form the solid type heat ray absorbing layer 171B with those wherein fine particles of metal oxide such as titanium oxide, aluminum oxide, zinc oxide, silicon oxide, magnesium oxide, or calcium carbonate having heat ray transmissivity (mainly infrared ray transmissivity or far infrared ray transmissivity) of average particle size of not more than 1 μm, preferably of not more than 0.1 μm including primary and secondary particles having a particle size of not more than ½, preferably ⅕ of a wavelength of heat ray are dispersed in resin binders.

According to FIG. 7, it is preferable to generate heat inside heat ray absorbing layer 171*b* by providing density distribution of the aforesaid heat ray absorbing member on the heat ray absorbing layer 171*b* of heat ray fixing roller 17*a* representing a roll-shaped rotary member for heat ray fixing. In an arrangement with regard to density distribution on the heat ray absorbing layer 171*b*, density on the boundary surface on the part of the elastic layer 171*d* which is inscribed is made to be low, then density is gradually raised toward the outer circumferential surface with a gradient, as shown in graph (U), and density is saturated to be the density for 100% absorption at the point just before the outer circumferential surface (the position corresponding to ⅔–⅘ of thickness t of heat ray absorbing layer 171*b* from the elastic layer 171*d*). Due to this, heat generation distribution caused by heat ray absorption on the heat ray absorbing layer 171*b* is formed to be in a shape of a parabola wherein the maximum value is positioned in the vicinity of the central portion of the heat ray absorbing layer 171*b* and the minimum value is positioned on the boundary surface of the heat ray absorbing layer 171*b* and in the vicinity of the outer circumferential surface as shown in graph (U). Owing to this, heat generation caused by heat ray absorption on the aforesaid boundary surface is made small, and damage of an adhesion layer on the boundary surface and damage of the heat ray absorbing layer 171*b* can be prevented. Further, density distribution from this side (the position corresponding to ⅔–⅘ of thickness t of heat ray absorbing layer 171*b* from the light transmitting base body 171*a*) to the outer circumferential surface on the outer circumferential surface side is made to be saturated, so that no influence may be given even when the outer surface layer is shaved when solid type heat ray absorbing layer 171B and solid type elastic layer 171D are used, for example, and even when the solid type heat ray absorbing layer 171B is used, in particular. Incidentally, a saturated layer may be formed as is shown with dotted lines. In short, if absorption is conducted fully inside, there is not influence of density outside. Influence of shaving is not exerted either. It is further possible to give inclination to the density distribution and to adjust heat generation distribution by changing an angle of inclination.

As outside diameter ϕ of roll-shaped light transmitting base body 171*a* of heat ray fixing roller 17*a* representing a roll-shaped rotary member for heat ray fixing, diameters ranging from 15 mm to 60 mm are used as shown in FIG. 8. With regard to wall thickness t, a thicker wall is better in terms of strength and thinner wall is better in terms of heat capacity. From the relation between strength and heat capacity, the relation between outside diameter ϕ and thickness t of the roll-shaped light transmitting base body 171*a* is represented by the following.

$0.05 \leqq t/\phi \leqq 0.20$ preferably, $0.07 \leqq t/\phi \leqq 0.14$

When outside diameter ϕ of light transmitting base body 171*a* is 40 mm, wall thickness t of the light transmitting base body 171*a* satisfying 2 mm≦t≦8 mm, preferably 2.8 mm≦t≦5.6 mm is used. When the ratio t/ϕ on the light transmitting base body 171*a* is less than 0.05, strength is insufficient, while when the ratio t/ϕ exceeds 0.20, heat capacity turns out to be greater and heat ray fixing roller 17*a* takes longer time to be heated. Even in the case of a light transmitting base body, it sometimes absorbs heat ray by 1–20%, depending on the material. Therefore, thinner one are better, provided that the strength can be maintained.

As stated above, pressurization at the fixing section (nipping section) by elasticity of a rotary member for heat ray fixing and heating by a heat ray absorbing layer of the rotary member for heat ray fixing provide satisfactory fusion to color toner which is difficult to be fixed by heat ray because of different spectral characteristics, and thereby provide a fixing unit for color toner capable of performing instant heating fixing on color toner having soft roller function or quick start fixing with a short heating time, while, fixing by means of pressurization at the fixing section (nipping section) by elasticity of a rotary member for heat ray fixing and of heating by a heat ray absorbing layer of the rotary member for heat ray fixing provides satisfactory fusion to superposed color toner images on a transfer material having a thick toner layer which is difficult to be fixed by heat ray because of different spectral characteristics, and thereby provides a color image forming apparatus capable of performing instant heating fixing on color toner having soft roller function or quick start fixing with a short heating time.

When there is used color-toner-use fixing unit 17 explained in FIG. 5, it is possible to realize a color-toner-use fixing unit which is highly resistant to deformation of the fixing section (nipping section) and is for quick start fixing by instant heating, and especially when a color image forming apparatus explained in FIG. 1 is used, quick start and instant heating fixing for color toner images can be carried out in the course of color image forming, and appropriate energy consumption can be realized on a rotary member for heat ray fixing, resulting in an effect of energy conservation. Further, it is possible to provide a color-toner-use fixing unit and a color image forming apparatus wherein a nipping section in the fixing area is wide, high fixing efficiency can be obtained and fixing requiring zero warming-up time can be carried out with low heat capacity, compared with a conventional color-toner-use fixing unit employing heating bodies in upper and lower rollers or with a color-toner-use film fixing unit employing a ceramic heater.

A variation of the rotary member for heat ray fixing in FIG. 5 will be explained, referring to FIG. 9. FIG. 9 is a structure diagram for the enlarged section of a variation of the rotary member for heat ray fixing on the upper side in FIG. 5.

According to FIG. 9, a variation of the rotary member for heat ray fixing on the upper side for fixing toner images can be represented by a soft roller wherein heat ray absorbing layer 171*b* stated in in FIG. 5, elastic layer 171*d* and releasing layer 171*c* are provided in this order on the outer side (outer circumferential surface) of cylindrical light transmitting base body 171*a* to form the rotary member for heat ray fixing, and heat ray irradiating member 171*g* representing a heat ray irradiating means employing, for example, a halogen lamp or a xenon lamp which mainly emits infrared rays or far infrared rays, is provided inside the light transmitting base body 171*a*. Materials and structures for the light transmitting base body 171*a*, heat-resistant resin layer 171*e*, heat ray absorbing layer 171*b*, elastic layer 171*d* and releasing layer 171*c* are the same as those explained in FIG. 6(*a*), and the same effect as in the rotary member for heat ray fixing explained in FIG. 5 can be obtained.

Figure 10:
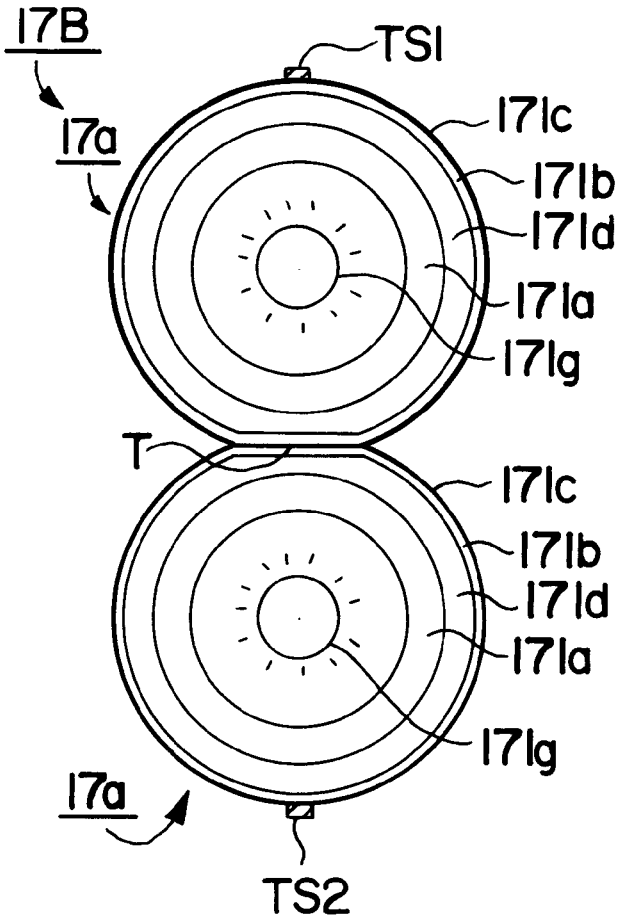
FIG. 10 is a diagram showing the second example of a color-toner-use fixing unit.

The second example of color-toner-use fixing unit 17B is one employing a pair of roll-shaped rotary members for heat ray fixing for instant heating in FIG. 5 which is structured by using heat ray fixing roller 17*a* identical to that explained in FIG. 5 as a roll-shaped rotary member for heat ray fixing on the upper side for fixing toner images on a transfer material or as a roll-shaped rotary member for heat ray fixing on the lower side, as shown in FIG. 10, and it nips recording sheet P (not shown) representing a transfer material at nipping section T which is formed between the upper and lower heat ray fixing rollers 17*a* and has a width of about 2–10 mm, and thereby fixes toner images on recording sheet P by applying heat and pressure.

Heat ray fixing roller 17*a* used as a rotary member for heat ray fixing on the upper side or as a rotary member for heat ray fixing on the lower side for fixing toner images on a transfer material is structured as a soft roller wherein cylindrical light transmitting base body 171*a,* elastic layer 171*d* on the outer side (outer circumferential surface) of the light transmitting base body 171*a,* heat ray absorbing layer 171*b,* and releasing layer 171*c* are provided in this order, heat ray irradiating member 171*g* representing a heat ray irradiating means employing, for example, a halogen lamp or a xenon lamp emitting mainly heat ray such as infrared rays or far infrared rays is arrange inside the light transmitting base body 171*a.* The heat ray fixing roller 17*a* representing each of the upper and lower rotary members for heat ray fixing is structured as a highly elastic soft roller in the manner stated above. Heat rays emitted from heat ray irradiating member 171*g* are absorbed by heat ray absorbing layer 171*b,* and a roll-shaped rotary member for heat ray fixing capable of heating instantly is formed. A roll-shaped rotary member for heat ray fixing for instant heating use employing the aforesaid solid type heat ray absorbing layer 171B or solid type elastic layer 171D is also used as a rotary member for heat ray fixing on the upper side or on the lower side. Between rotary members for heat ray fixing of the upper and lower soft rollers, there is formed softer and flat nipping section T where toner images are fixed.

TS1 represents a temperature sensor employing, for example, a thermistor for temperature control mounted on the heat ray fixing roller 17*a* on the upper side, and TS2 represents a temperature sensor employing, for example, a thermistor for temperature control mounted on the heat ray fixing roller 17*a* on the lower side.

Next, there will be explained a preferable example of the fixing unit wherein a heat conduction layer is provided to make temperature distribution of a heat ray absorbing layer uniform and to prevent damage of a light transmitting base body.

Figure 11:
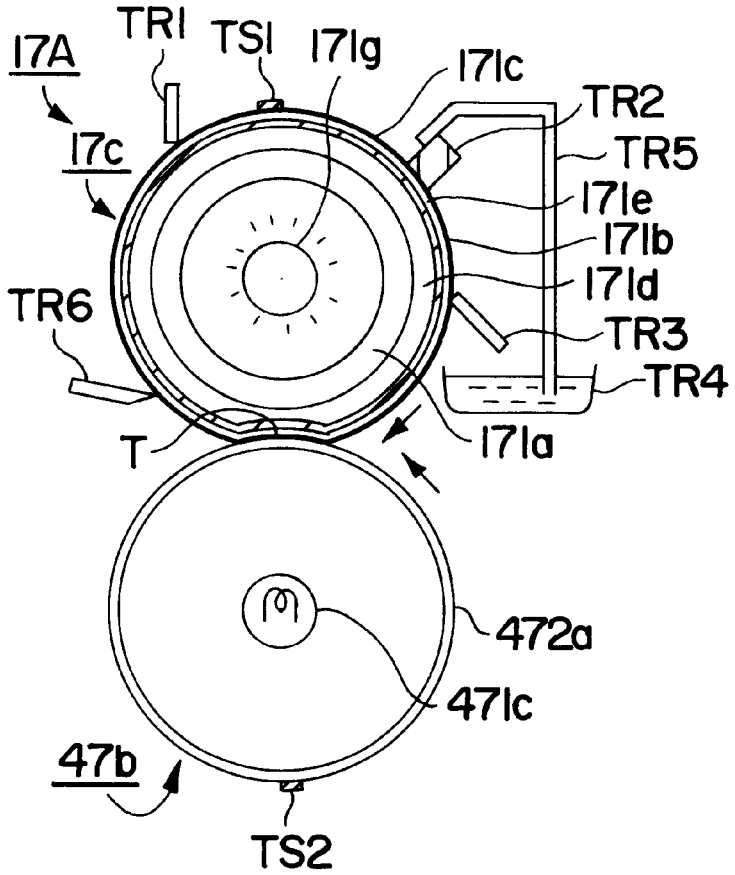
FIG. 11 is an illustration showing the structure of the third example of a fixing unit.

As shown in FIG. 11, in the third example of fixing unit 17C, heat ray fixing roller 17*c* representing a rotary member for heat ray fixing for fixing toner images of the obverse side images is structured as a soft roller wherein there is provided cylindrical light transmitting base body 171*a* which is provided on its outer side (outer circumferential surface) with elastic layer 171*d,* heat ray absorbing layer 171*b,* heat conduction layer 171*e* and releasing layer 171*c* in this order, and provided in its inside with heat ray irradiating member 171*g* representing a heat ray irradiating means employing, for example, a halogen lamp or a xenon lamp emitting mainly heat ray such as infrared rays or far infrared rays. Heat ray emitted from heat ray irradiating member 171*g* is absorbed by heat ray absorbing layer 171*b,* and a cylindrical rotary member for heat ray fixing capable of instant heating is formed by heat conduction layer 171*e* which makes surface temperature of heat ray fixing roller 17*c* caused by heat absorbed by heat ray absorbing layer 171*b* uniform. On the heat ray fixing roller 17*c* representing a cylindrical rotary member for heat ray fixing provided on the upper side, there are provided fixing separation claw TR6, fixing oil cleaning blade TR1, oil coating felt TR2 and oil amount regulating blade TR3 in the rotary direction of the heat ray fixing roller 17*c* from the position of nipping section T, and oil supplied from oil tank TR4 to oil coating felt TR2 through capillary pipe TR5 is coated on the heat ray fixing roller 17*c* by oil coating felt TR2. Oil staying on the circumferential surface of the heat ray fixing roller 17*c* is removed by the fixing oil cleaning blade TR1. Therefore, temperature sensor TS1 which measures temperature of the heat ray fixing roller 17*c* which will be described later is provided on the circumferential surface of the cleaned heat ray fixing roller 17*c* between the fixing oil cleaning blade TR1 and the oil coating felt TR2. A transfer material after fixing is separated by the fixing separation claw TR6.

Fixing roller 47*b* representing a rotary member for fixing which fixes toner images of reverse side images is formed with cylindrical metal pipe 472*a* employing, for example, aluminum material or steel material, whose outer circumferential surface is subjected to Teflon coating by baking or coating, and is structured as a hard roller wherein halogen heater 471*c* is arranged inside metal pipe 472*a.* Between the soft roller on the upper side and the hard roller on the lower side, there is formed nipping section T whose upper side is convex where toner images are fixed.

TS1 represents a temperature sensor employing, for example, a thermistor which is mounted on the heat ray fixing roller 17*c* on the upper side and controls temperature, while TS2 represents a temperature sensor employing, for example, a thermistor which is mounted on the fixing roller 47*b* on the lower side and controls temperature.

Figure 12A:
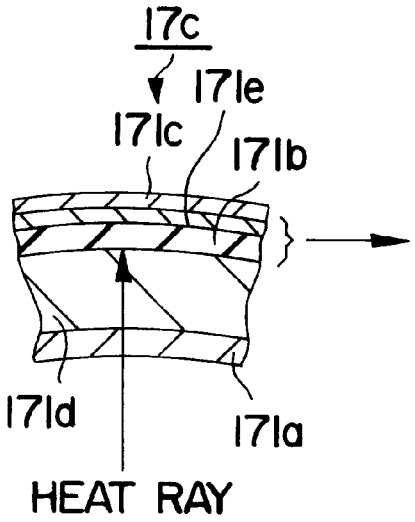
FIGS. 12(*a*) and 12(*b*) are enlarged section structure diagram of a roll-shaped rotary member for heat ray fixing.
Figure 12B:
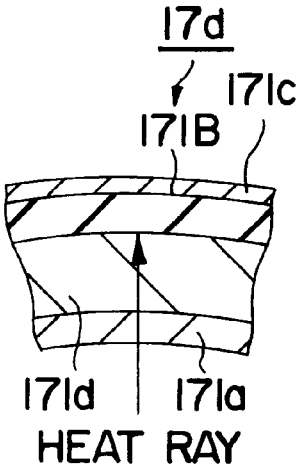

According to FIG. 12, a roll-shaped rotary member for heat ray fixing representing a soft roller used in the third example of fixing unit 17C is divided into the following four types depending on the structure of a heat ray absorbing layer and a heat conduction layer.

First, heat ray fixing roller 17*c* is one having the structure wherein heat ray absorbing layer 171*b* and heat conduction layer 171*e* are formed separately on the outer side (outer circumferential surface) of elastic layer 171*d* on the outer side of light transmitting base body 171*a,* as is explained in FIG. 11 and is shown as a section in FIG. 12(*a*), and it includes two types; one is an example of type A having the structure wherein a binder type one (first heat ray absorbing layer) is used as heat ray absorbing layer 171*b* and a binder type one (first heat conduction layer) is used likewise as heat conduction layer 171*e,* and the other is an example of type B having the structure wherein a binder type one (second heat ray absorbing layer) is used as heat ray absorbing layer 171*b* and a solid type one (second heat conduction layer) is used as heat conduction layer 171*e.* Heat rays emitted from the heat ray irradiating member are absorbed by heat ray absorbing layer 171*b* through light transmitting base body 171*a* and elastic layer 171*d.* Further, it is one to use heat ray fixing roller 17*d* wherein combination layer 171B serving as both heat ray absorbing layer 171*b* and heat conduction layer 171*e* is formed on the outer side (outer circumferential surface) of elastic layer 171*d,* and its structure includes two types; one is an example of type C to use a binder type one (first combination layer) as combination layer 171B, and the other is an example of type D to use a solid type one (second combination layer) as combination layer 171B. Heat ray emitted from heat ray irradiating member are is absorbed by combination layer 171B through light transmitting base body 171*a* and elastic layer 171*d.*

Type A of the structure for the heat ray absorbing layer and the heat conduction layer will be explained as follows.

As cylindrical light transmitting base body 171*a* and elastic layer 171*d,* those explained in FIG. 5 can be used.

With regard to heat ray absorbing layer 171*b* of a binder type representing the first heat ray absorbing layer, there is used a heat ray absorbing member wherein powder of carbon black, graphite, black iron oxide ($Fe_3O_4$), various ferrite and their compounds, oxidized copper, cobalt oxide and Indian red ($Fe_2O_3$) is mixed, so that there may be formed a rotary member for heat ray fixing which absorbs 90–100%, preferably 95–100% corresponding to almost 100% of heat rays emitted from heat ray irradiating member 171*g* and transmitted through light transmitting base body 171*a* and elastic layer 171*d* with heat ray absorbing layer 171*b* and is capable of heating instantly, and the heat ray absorbing member having a thickness of 10–200 μm, preferably of 20–100 μm is formed on the outer side (outer circumferential surface) of the elastic layer 171*d* in a way of blasting or of coating.

Further, since the wavelength of a heat ray projected on heat ray absorbing layer 171*b* is 0.1–20 μm, preferably is 0.3–3 μm, it is also possible to form the heat ray absorbing layer 171*b* with those wherein fine particles of metal oxide such as titanium oxide, aluminum oxide, zinc oxide, silicon oxide, magnesium oxide, or calcium carbonate having heat ray transmissivity (mainly infrared ray transmissivity or far infrared ray transmissivity) of average particle size of not more than 1 μm, preferably of not more than 0.1 μm including primary and secondary particles having a particle size of not more than ½, preferably ⅕ of a wavelength of heat ray are dispersed at the rate of 5–50% by weight in resin binders.

In addition to the foregoing, the method of form heat ray absorbing layer 171*b* includes an enameling method wherein opaque enamel coating is coated on elastic layer 171*d* in a dipping or spray method, and then, it is baked at a certain temperature to deposit the enamel coating on the elastic layer 171*d,* and a luster method wherein a metal-dissolved solution is coated in a way of a dipping or blasting method likewise, then, a medium portion is baked off and metal is baked on the surface of the elastic layer 171*d,* and the heat ray absorbing layer 171*b* can also be formed in the enameling method or the luster method.

Since the heat capacity of the heat ray absorbing layer 171*b* is made to be small so that its temperature may rise quickly, a problem that temperature drop of heat ray fixing roller 17*c* representing a rotary member for heat ray fixing take place to cause uneven fixing is lessened. However, temperature distribution in the longitudinal direction ((which is also called the lateral direction) the direction which is in parallel with the central axis of cylindrical light transmitting base body 171*a*) of heat ray absorbing layer 171*b* on the surface of elastic layer 171*d* which is located on the outer side (outer circumferential surface) of cylindrical light transmitting base body 171*a* is hard to be made uniform.

Therefore, heat conduction layer 171*e* of a binder type representing the first heat conduction layer is provided on the outer side (outer circumferential surface) of heat ray absorbing layer 171*b*. The heat conduction layer 171*e* of a binder type representing the first heat conduction layer is of the structure of a layer which is 10–1000 μm, preferably 50–500 μm in thickness, and is made of a resin binder in which fine particles of metal such as heat-conductive titanium, alumina, zinc, magnesium, chromium, nickel, tantalum and molybdenum are dispersed, and has thermal conductivity of $50\times10^{-3}$ J/cm·s·k, preferably $100\times10^{-3}$ J/cm·s·k or more. When the thickness of heat conduction layer 171*e* is less than 10 μm, the layer thickness is too thin to secure appropriate heat capacity, heat from heat ray absorbing layer 171*b* can not be transmitted in the lateral direction, and heat in the lateral direction can not be made uniform. When the thickness exceeds 1000 μm, the heat capacity is made to be too large, warming-up requires more time, and instant heating becomes difficult. When a heat conduction layer is provided, heat is transmitted from the heat ray absorbing layer to the heat conduction layer immediately, and temperature distribution in the longitudinal direction ((the lateral direction) the direction which is in parallel with the central axis of cylindrical light transmitting base body) of the heat ray absorbing layer is made uniform by heat transfer in the lateral direction on the heat conduction layer.

Type B with the structure of a heat ray absorbing layer and a heat conduction layer will be explained.

In the present example, with regard to light transmitting base body 171*a,* elastic layer 171*d,* heat ray absorbing layer 171*b* and releasing layer 171*c,* those having the same structure, function and effect as those explained in the previous example are used, and heat ray fixing roller 17*c* is formed by using the solid type one (second heat conduction layer) as heat conduction layer 171*e*.

Similarly to the foregoing, temperature distribution in the longitudinal direction ((called also lateral direction) the direction which is in parallel with a central axis of cylindrical light transmitting base body 171*a*) of heat ray absorbing layer 171*b* on the surface of elastic layer 171*d* located on the outer side (outer circumferential surface) of cylindrical light transmitting base body 171*a* is hard to be made uniform. Therefore, heat conduction layer 171*e* of a fixed type representing a second heat conduction layer is provided on the outer side (outer circumferential surface) of the heat ray absorbing layer 171*b*. With regard to the heat conduction layer 171*e* of a fixed type representing a second heat conduction layer, a layer having a layer thickness (thickness) of 10–1000 μm, preferably 50–500 μm is formed on the surface of the heat ray absorbing layer 171*b* by plating, spattering or evaporating metal having excellent heat conducting property such as, for example, chromium, nickel, tantalum or molybdenum so that the layer has heat conductivity of $50\times10^{-3}$ J/cm·s·K, preferably $100\times10^{-3}$ J/cm·s·K or more. When the thickness of the heat conduction layer 171*e* is less than 10 μm, the layer is too thin, heat capacity is insufficient, heat from the heat ray absorbing layer 171*b* can not be transferred sufficiently in the lateral direction, and heat in the lateral direction can not be made uniform. When the thickness exceeds 1000 μm to be too great, heat capacity becomes too great, warming-up takes a longer time, and instant heating is difficult. When a heat conduction layer is provided, heat is transmitted quickly from a heat ray absorbing layer to a heat conduction layer, and uniform temperature distribution in the longitudinal direction ((lateral direction) the direction that is in parallel with the central axis of a cylindrical light transmitting base body) of the heat ray absorbing layer can be achieved by the spread of heat in the lateral direction on the heat conduction layer. Further, when a heat conduction layer of a solid type is provided on the outer side of a light transmitting base body, the light transmitting base body is protected strongly by the heat conduction layer, and damage of the light transmitting base body can be prevented.

Type C of the structure of a neat wave absorbing layer and a heat conduction layer will be explained as follows.

The present example is one wherein a first combination-type layer of a binder type is used as combination-type layer 171B in heat ray fixing roller 17*d* in which the combination-type layer 171B serving as both heat ray absorbing layer 171*b* and heat conduction layer 171*e* is formed on the outer side (outer circumferential surface) of elastic layer 171*d* arranged on the out side of light transmitting base body 171*a*. The light transmitting base body 171*a,* the elastic layer 171*d* and releasing layer 171*c* which are the same as those described in the example stated above in terms of structure, function and effect, are used.

Temperature distribution in the longitudinal direction ((lateral direction) the direction that is in parallel with the central axis of a cylindrical light transmitting base body) on the surface of the combination-type layer 171B on the outer side (outer circumferential surface) of the elastic layer 171*d* is hard to be made uniform. Therefore, the combination-type layer 171B of a binder type representing the first combination-type layer is made to be of a layer structure wherein a layer thickness (thickness) is 10–1000 μm, preferably 50–500 μm, and heat conductivity is $50\times10^{-3}$ J/cm·s·K, preferably $100\times10^{-3}$ J/cm·s·K, or more, by blasting or coating heat ray absorbing member in which power of carbon black, graphite, black iron oxide ($Fe_3O_4$), various ferrite and their compounds, oxidized copper, cobalt oxide or Indian red ($Fe_2O_3$) is mixed, or blasting or coating those wherein fine particles of metal such as heat conductive titanium, alumina, zinc, magnesium, chromium, tantalum, or molybdenum are dispersed in resin binder, or by blasting or coating glass ink wherein coloring pigment such as carbon black or iron oxide is kneaded into glass fine powder, so that there may be formed a rotary member for heat ray fixing wherein 90–100%, preferably 95–100% corresponding to almost 100% of heat ray emitted from heat ray irradiating member 171*g* and transmitted through light transmitting base body 171*a* and elastic layer 171*d* is absorbed by the combination-type layer 171B and instant heating is possible. When the thickness of the combination-type layer 171B is less than 10 μm, the layer is too thin, heat capacity is insufficient, heat on the combination-type layer 171B can not be transferred sufficiently in the lateral direction, and heat in the lateral direction can not be made uniform. When the thickness exceeds 1000 μm to be too great, heat capacity becomes too great, warming-up takes a longer time, and instant heating is difficult. When the thickness of the combination-type layer 171B is less than 10 μm to be thin, local heating caused by a thin film can cause damage or insufficient strength of the combination-type layer 171B although heating speed caused by heat ray absorption by the combination-type layer 171B is high. When the thickness of the combination-type layer 171B exceeds 1000 μm to be too thick, troubles in heat conduction are caused, heat capacity becomes greater, and instant heating becomes difficult. By providing the combination-type layer, temperature distribution in the longitudinal direction ((lateral direction) the direction that is in parallel with the central axis of a cylindrical light transmitting base body) of the combination-type layer can be made uniform,-by spread of heat in the lateral direction on the combination-type layer. Further, since the wavelength of a heat ray projected on the combination-type layer 171B is 0.1–20 μm, preferably is 0.3–3 μm, it is also possible to form the combination-type layer 171B with those wherein fine particles of metal oxide such as titanium oxide, aluminum oxide, zinc oxide, silicon oxide, magnesium oxide, or calcium carbonate having heat ray transmissivity (mainly infrared ray transmissivity or far infrared ray transmissivity) of average particle size of not more than 1 μm, preferably of not more than 0.1 μm including primary and secondary particles having a particle size of not more than ½, preferably ⅕ of a wavelength of heat ray are dispersed at the rate of 5–50% by weight in the resin binder.

For achieving better property of releasing from toner, the one covered by PFA (fluorine resin) tube having a thickness of 30–100 μm or releasing layer 171*c* on which fluorine resin (PFA or PTFE) coating is coated to be a thickness of 20–30 μm is provided on the outer side (outer circumferential surface) of the combination-type layer 171B to be separated from the combination-type layer 171B.

Type D of the structure of a neat wave absorbing layer and a heat conduction layer will be explained as follows.

The present example is one wherein a fourth combination-type layer of a solid type is used as combination-type layer 171B in heat ray fixing roller 17*d* in which the combination-type layer 171B serving as both heat ray absorbing layer 171*b* and heat conduction layer 171*e* is formed on the outer side (outer circumferential surface) of elastic layer 171*d* arranged on the out side of light transmitting base body 171*a*. The light transmitting base body 171*a*, the elastic layer 171*d* and releasing layer 171*c* among constituting members of heat ray fixing roller 17*d* which are the same as those described in the fifth example stated above in terms of structure, function and effect, are used.

Temperature distribution in the longitudinal direction ((lateral direction) the direction that is in parallel with the central axis of a cylindrical light transmitting base body) on the surface of the combination-type layer 171B on the outer side (outer circumferential surface) of the elastic layer 171*d* is hard to be made uniform. Therefore, the combination-type layer 171B of a solid type representing the second combination-type layer is made to be of a layer structure wherein a layer thickness (thickness) is 10–1000 μm, preferably 50–500 μm, and a layer is formed by blasting or coating powder of heat conductive metal such as chromium, nickel, tantalum or molybdenum on the surface of the light transmitting base body 171*a*, and heat conductivity is $50\times10^{-3}$ J/cm·s·K, preferably $100\times10^{-3}$ J/cm·s·K or more. In particular, a chromium type alloy is preferable for light absorption. In addition, a method of forming the combination-type layer 171B includes an enameling method wherein opaque enamel coating containing oxide of the heat conductive metal or metal fine powder is coated on the elastic layer 171*d* by the way of dipping or s spray method and then is baked at a certain temperature so that enamel coating may be deposited on the elastic layer 171*d*, and a luster method wherein a metal solution is coated likewise through dipping or a spray method, then a medium portion is baked off so that metal may be baked on the surface of the elastic layer 171*d*, and the combination-type layer 171B can also be formed by the enameling method and the luster method. When the thickness of the combination-type layer 171B is less than 10 μm, the layer is too thin and heat capacity is insufficient, and thereby, heat on the combination-type layer 171B can not be transmitted in the lateral direction sufficiently and heat in the lateral direction is hard to be made uniform. When the thickness exceeds 1000 μm to be too thick, heat capacity becomes too great, warming-up takes a longer time, and instant heating is difficult. By providing the combination-type layer, temperature distribution in the longitudinal direction ((lateral direction) the direction which is in parallel with the central axis of a cylindrical light transmitting base body) of the combination-type layer can be made uniform. It is preferable to form a layer through blasting or coating by mixing heat ray absorbing member in which power of carbon black, graphite, black iron oxide ($Fe_3O_4$), various ferrite and their compounds, oxidized copper, cobalt oxide or Indian red ($Fe_2O_3$) is mixed, and fine particles of metal such as heat conductive titanium, alumina, zinc, magnesium, chromium, nickel, tantalum, or molybdenum into the aforesaid metal powder so that there may be formed a rotary member for heat ray fixing wherein 90–100%, preferably 95–100% corresponding to almost 100% of heat ray emitted from heat ray irradiating member 171*g* and transmitted through light transmitting base body 171*a* and elastic layer 171*d* is absorbed by the combination-type layer 171B and instant heating is possible. When the thickness of the combination-type layer 171B is less than 10 μm, the layer is too thin and heat capacity is insufficient, and thereby, heat on the combination-type layer 171B can not be transmitted in the lateral direction sufficiently and heat in the lateral direction is hard to be made uniform. When the thickness exceeds 1000 μm to be too thick, heat capacity becomes too great, warming-up takes a longer time, and instant heating is difficult. When the thickness of the combination-type layer 171B is less than 10 μm to be thin, local heating caused by a thin film can cause damage or insufficient strength of the combination-type layer 171B although heating speed caused by heat ray absorption by the combination-type layer 171B is high. When the thickness of the combination-type layer 171B exceeds 1000 μm to be too thick, troubles in heat conduction are caused, heat capacity becomes greater, and instant heating becomes difficult. By providing the combination-type layer, temperature distribution in the longitudinal direction ((lateral direction) the direction that is in parallel with the central axis of a cylindrical light transmitting base body) of the combination-type layer can be made uniform, by spread of heat in the lateral direction on the combination-type layer. Further, since the wavelength of a heat ray projected on the combination-type layer 171B is 0.1–20 μm, preferably is 0.3–3 μm, it is also possible to form the combination-type layer 171B with those wherein fine particles of metal oxide such as titanium oxide, aluminum oxide, zinc oxide, silicon oxide, magnesium oxide, or calcium carbonate having heat ray transmissivity (mainly infrared ray transmissivity or far infrared ray transmissivity) of average particle size of not more than 1 μm, preferably of not more than 0.1 μm including primary and secondary particles having a particle size of not more than ½, preferably ⅕ of a wavelength of heat ray are dispersed at the rate of 5–50% by weight in the metal powder.

Figure 13:
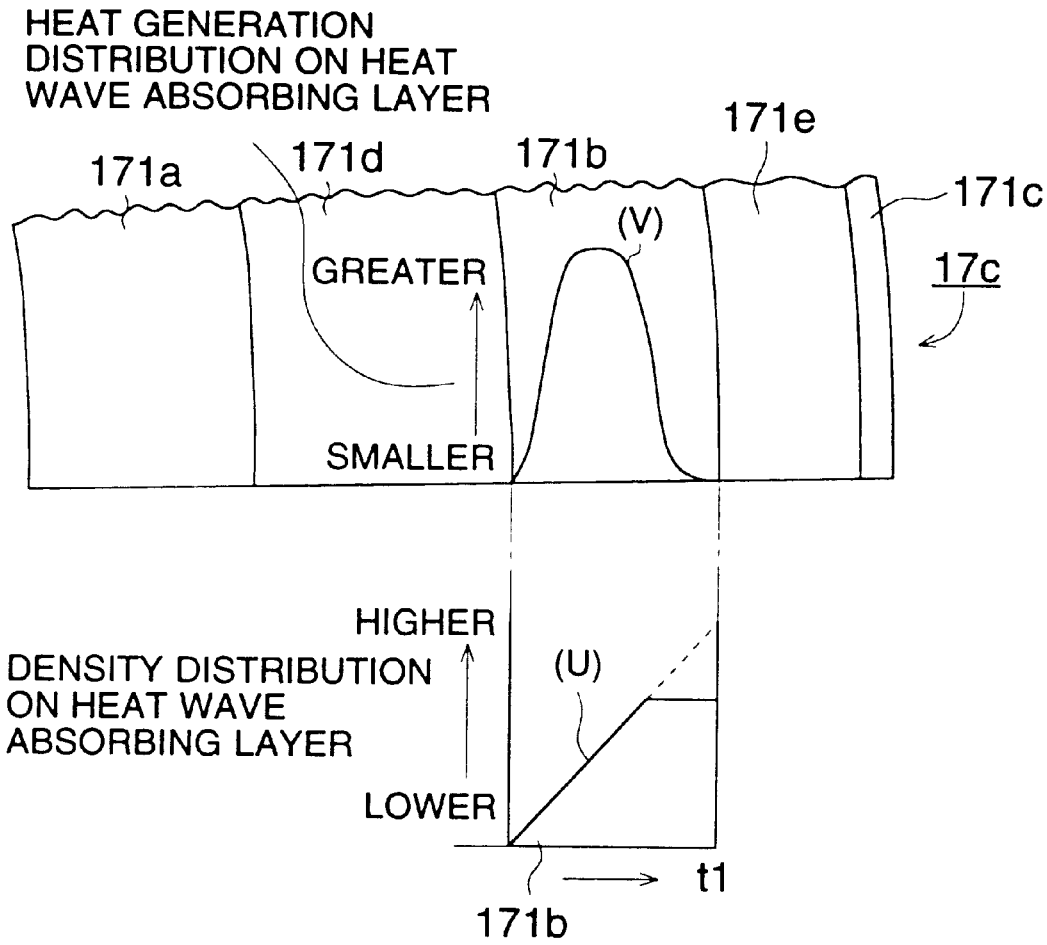
FIG. 13 is a diagram showing density distribution of a heat ray absorbing layer of a roll-shaped rotary member for heat ray fixing.

According to FIG. 13, it is preferable to generate heat inside heat ray absorbing layer 171*b* by providing density distribution of the aforesaid heat ray absorbing member on heat ray absorbing layer 171*b* of heat ray fixing roller 17*c* representing a roll-shaped rotary member for heat ray fixing explained in FIG. 12(*a*). As shown in graph (U), in the density distribution of heat ray absorbing layer 171*b,* low density is positioned at the boundary surface on the part of inscribed elastic layer 171*d,* and density is gradually raised toward the outer circumferential surface to be inclined to be the density corresponding to 100% absorption to be saturated at the point just before the outer circumferential surface (the position being far from light transmitting base body 171*a* by ⅔–⅘ for the thickness tl of heat ray absorbing layer 171*b*). Due to this, the density distribution caused by absorption of heat ray on heat ray absorbing layer 171*b* is formed to be a parabola wherein the maximum value is in the vicinity of the central portion of heat ray absorbing layer 171*b* and the minimum value is in the vicinity of the boundary surface or an outer circumferential surface of heat ray absorbing layer 171*b,* as shown in graph (V). Due to this, heat generation caused by heat ray absorption on the aforesaid boundary surface is made to be small, and damage of an adhesion layer on the boundary surface and damage of heat ray absorbing layer 171*b* are prevented. Further, the density distribution from the point just before the outer circumferential surface (the position being far from elastic layer 171*d* by ⅔–⅘ for the thickness t1 of heat ray absorbing layer 171*b*) to the outer circumferential surface is made to be saturated, so that nothing is influenced even when a layer on the outer circumferential surface is ground when a solid type heat ray absorbing layer (not shown), for example, is used. Incidentally, as shown with dotted lines, a saturation layer may be formed. In short, if sufficient absorption is carried out internally, density has no influence outside. There is no influence of grinding. It is also possible to give an inclination to density distribution, and to adjust heat generation distribution by changing an angle of the inclination.

Figure 14:
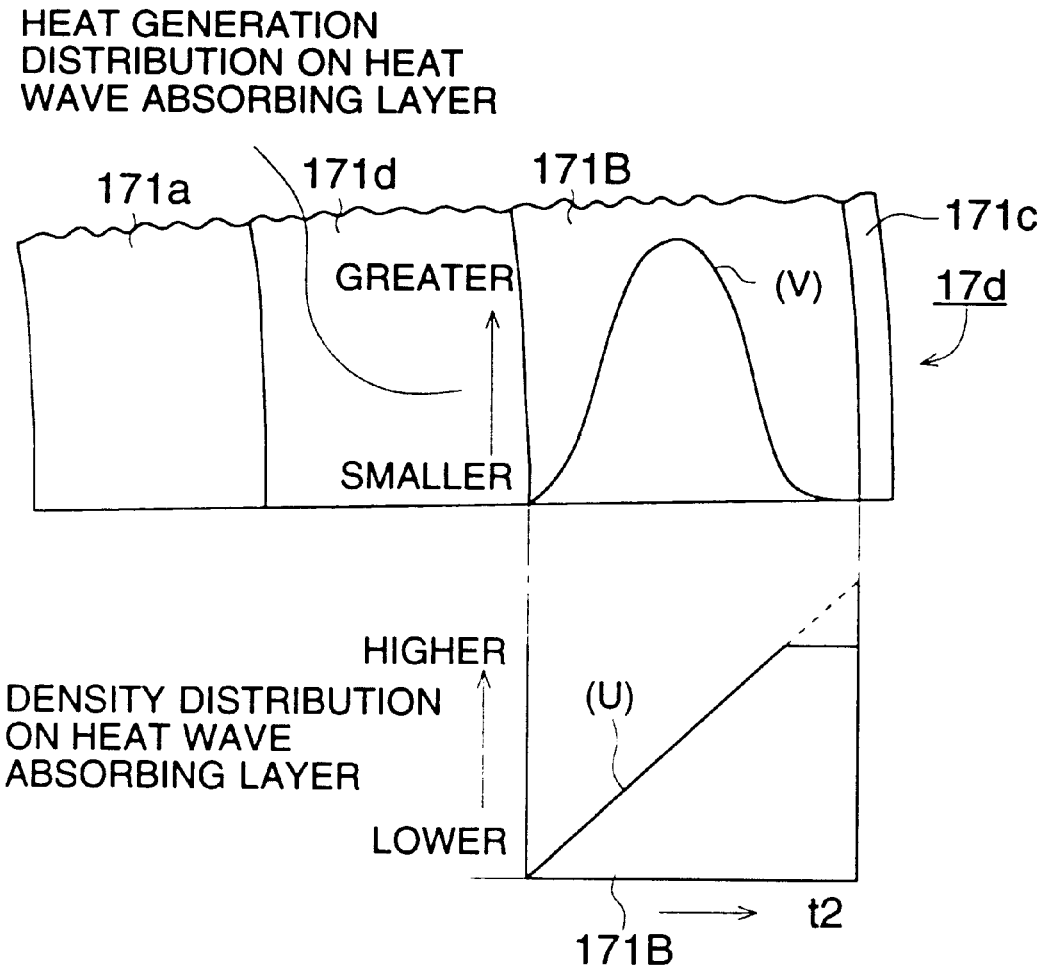
FIG. 14 is a diagram showing density distribution of a combination layer of a roll-shaped rotary member for heat ray fixing.

According to FIG. 14, it is preferable to generate heat inside combination-type layer 171B by providing density distribution of the aforesaid heat ray absorbing member on the combination-type layer 171B of heat ray fixing roller 17*d* representing a roll-shaped rotary member for heat ray fixing explained in FIG. 12(*b*). As the density distribution of the combination-type layer 171B is shown in graph U, and heat generation distribution is shown in graph V, it is preferable to take the same pattern as those shown in graphs U and V in FIG. 13.

When there is used fixing unit 17 of type A or type B in terms of the structure of a heat ray absorbing layer and a heat conduction layer in the examples of FIG. 11 and FIG. 12, heat absorbed by the heat ray absorbing layer is made uniform by the heat conduction layer, which makes it possible to conduct fixing using quick start heat ray wherein instant heating is possible or heating time is short. Further, owing to pressurization at soft fixing section (nipping section) by an elastic layer and to heating by a heat ray absorbing layer, it is possible to conduct favorably the fusion of color toner which is difficult to be fixed by heat ray due to different spectral characteristics, and fixing with instant heating for color toner having functions of soft roller, or quick start fixing requiring short heating time is possible. The light transmitting base body is firmly protected by a heat conduction layer, and damage of the light transmitting base body can be prevented. When there is used fixing unit 17 of type C or type D in terms of the structure of a heat ray absorbing layer and a heat conduction layer in the example of FIG. 12(*b*), heat is absorbed by the combination-type layer and is made uniform, which makes it possible to conduct fixing which uses heat ray that is capable of instant heating or is of quick start with short heating time. Further, owing to pressurization at soft fixing section (nipping section) by an elastic layer and to heating by the combination-type layer, it is possible to conduct favorably the fusion of color toner which is difficult to be fixed by heat ray due to different spectral characteristics, and fixing with instant heating for color toner having functions of soft roller, or quick start fixing requiring short heating time, is possible. The light transmitting base body is firmly protected by the combination-type layer, and damage of the light transmitting base body can be prevented. In particular, the use of an image forming apparatus explained in FIG. 1 makes it possible to conduct quick start and instant heating fixing for toner images in the case of forming single-sided images for the obverse side which is frequently used. Further, an effect of energy conservation can be obtained. In addition, owing to the fixing through pressurization at soft fixing section (nipping section) by elasticity of an elastic layer of the rotary member for heat generation fixing and heating by the heat ray absorbing layer of the rotary member for heat generation fixing or by the combination-type layer, it is possible to conduct favorably the fusion of superposed color toner images on a transfer material with thick toner images which is difficult to be fixed by heat ray due to different spectral characteristics, and fixing with instant heating for color toner images or quick start fixing requiring short heating time for color toner images, is possible. In the conventional fixing unit for color toner employing a heat generator in either an upper soft roller or a lower soft roller, a rubber layer used as an elastic layer is deteriorated, because temperature of a core metal is raised to shorten the warming-up time at the start, in particular, in the case of a soft roller whose core metal is a metal pipe. In addition, the rubber layer has poor heat conductivity, making the warming-up time to be long. Compared with this, in the case of the present rotary member for heat ray fixing employing an elastic layer, there is provided a fixing unit for color toner wherein deterioration is less because no excessive heating takes place on the elastic layer, a life of the rotary member for heat ray fixing is long, and fixing with low heat capacity and zero warming-up time is possible.

Figure 15:
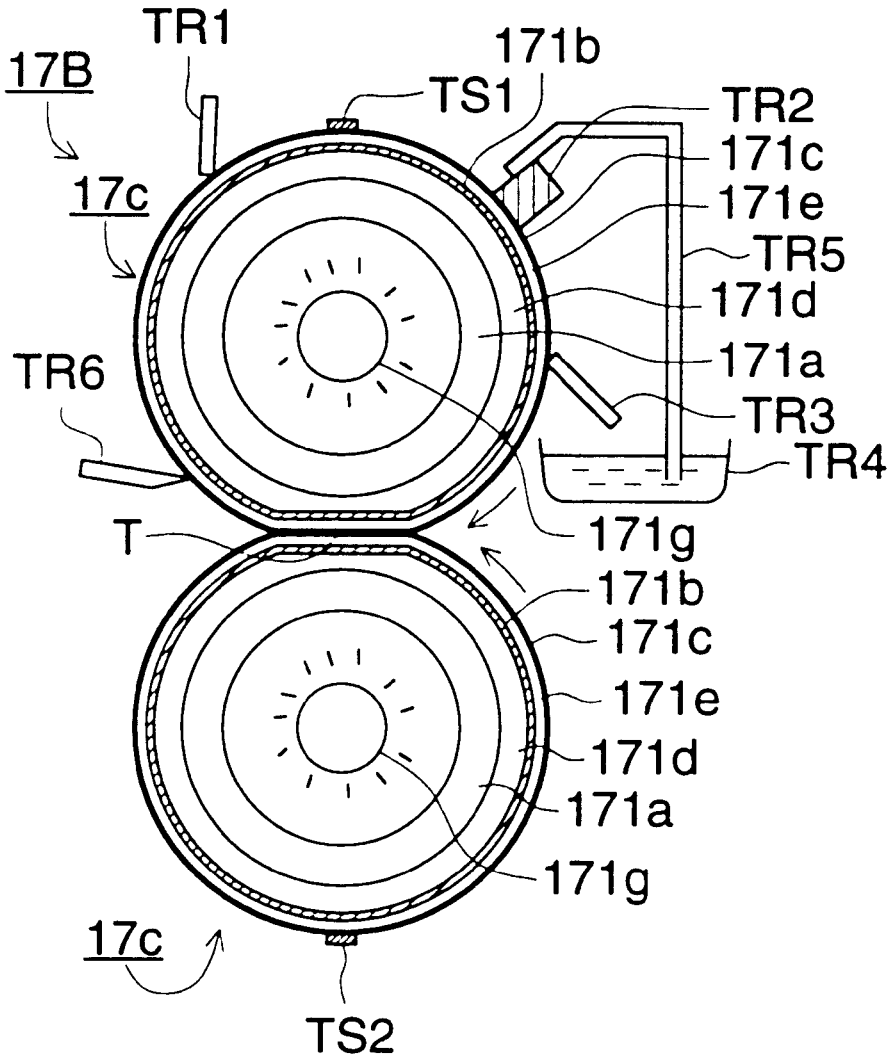
FIG. 15 is a diagram showing the fourth example of a fixing unit.

Fixing unit 17D in the fourth example employing a roll-shaped rotary member for heat ray fixing for two-sided fixing and for instant heating is structured by the use of heat ray fixing roller 17*c* identical to that explained in FIG. 11 and FIG. 12(*a*) or heat ray fixing roller 17*d* explained in FIG. 12(*b*), as a roll-shaped rotary member for heat ray fixing for the upper side (obverse side) for fixing toner images of the obverse side images (images on the upper side) or as a roll-shaped rotary member for heat ray fixing for the lower side (reverse side) for fixing toner images of the reverse side images (images on the lower side), as shown in FIG. 15, wherein recording sheet P is nipped at nipping section T having a width of about 2–10 mm formed between the upper rotary member for heat ray fixing and the lower rotary member for heat ray fixing, and toner images on the recording sheet P is fixed when heat and pressure are applied thereto. On the rotary member for heat ray fixing provided on the upper side, there are provided, from the nipping section T, fixing separation claw TR6, fixing oil cleaning blade TR1, oil coating felt TR2, and oil amount regulating blade TR3 in the rotary direction of the rotary member for heat ray fixing, and oil supplied from oil tank TR4 to the oil coating felt TR2 through capillary tube TR5 is coated on the rotary member for heat ray fixing by the oil coating felt TR2. The fixing oil cleaning blade TR1 removes oil staying on the circumferential surface of the rotary member for heat ray fixing. Therefore, temperature sensor TS1 which measures temperature on the rotary member for heat ray fixing described later is provided on the cleaned circumferential surface of the rotary member for heat ray fixing between the fixing oil cleaning blade TR1 and the oil coating felt TR2. A transfer material after being subjected to fixing is separated by the fixing separation claw TR6.

Between the rotary members for heat ray fixing representing upper and lower soft rollers, there is formed plane-shaped nipping section T where toner images are fixed.

TS1 represents a temperature sensor employing, for example, a thermistor for regulating temperature which is mounted on heat ray fixing roller 17*c* representing an upper rotary member for heat ray fixing or on heat ray fixing roller 17*d* (not shown), and TS2 represents a temperature sensor employing, for example, a thermistor for regulating temperature which is mounted on heat ray fixing roller 17*c* representing a lower rotary member for heat ray fixing or on heat ray fixing roller 17*d* (not shown).

Fixing temperature control in an image forming apparatus for two-sided image forming shown in FIG. 1 to which a fixing unit shown in FIGS. 5, 10, 11 or 15 is applied will be explained as follows.

Figure 16:
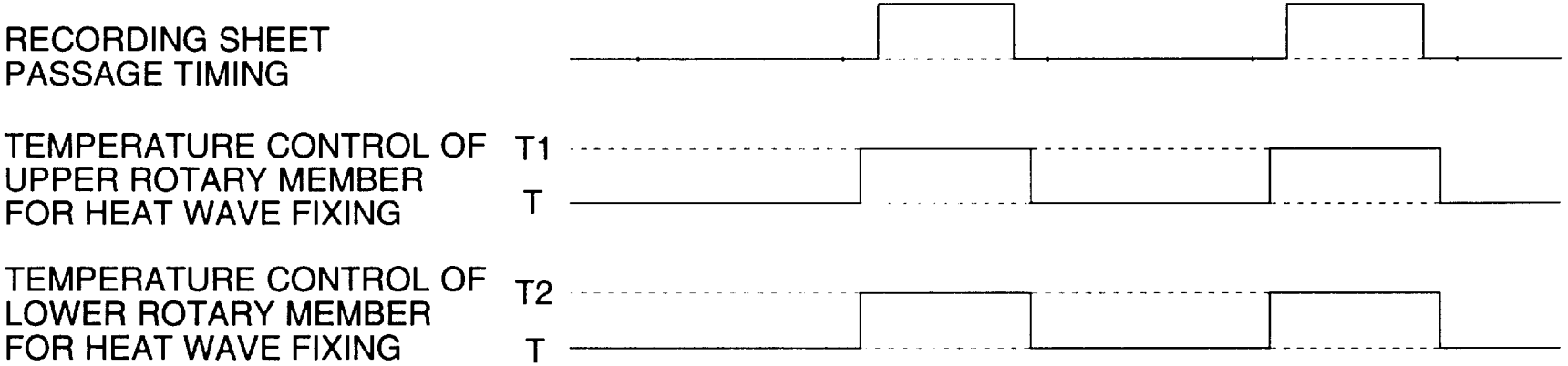
FIG. 16 is a temperature control timing chart in the continuous printing of two-sided image forming.

As is shown in FIG. 16, in the timing for conveying recording sheet P passing through a fixing unit in concert with image forming for the obverse side and the reverse side conducted by photoreceptor drum 10, in the course of two-sided image forming, conveyance is conducted at an interval of one recording sheet intermittently, which is different from continuous printing for single-sided image forming for the obverse side. In this case, on the upper roll-shaped rotary member for heat ray fixing for fixing toner images of the obverse side image, heat ray irradiating member 171*g* representing an upper heat ray irradiating means is turned on to be heated in synchronization with the timing for recording sheet P to pass, thus, there is conducted temperature control of the upper rotary member for heat ray fixing for alternate levels of fixing temperature set value T for suspension of image forming and appropriate fixing temperature set value T1 for image forming.

In the same way as this, on the lower roll-shaped rotary member for heat ray fixing for fixing toner images of the reverse side image, heat ray irradiating member 171*g* representing a heat ray irradiating means is turned on to be heated in synchronization with the timing for recording sheet P to pass, thus, there is conducted temperature control of the lower rotary member for heat ray fixing for alternate levels of fixing temperature set value T for suspension of image forming and appropriate fixing temperature set value T1 for image forming. In that case, two-sided image forming is conducted at an interval of one recording sheet intermittently, and thereby, non-passing time for recording sheet P is long. Therefore, fixing for two-sided images can be conducted even by upper and lower rotary members for heat ray fixing for instant heating wherein temperature can be controlled and can be made uniform, and heat capacity is small.

Temperature control is conducted by fixing temperature set values T, T1 and T2 stored in ROM in advance and by detection by temperature sensors TS1 and TS2 through comparative circuits and a control section (see FIG. 4).

In FIG. 16, temperature control for upper and lower rotary members for heat ray fixing is conducted in the area where the leading edge and trailing edge of recording sheet P are nipped. However, when the linear speed is high, the temperature control timing is set to be earlier slightly, or it is even necessary to set to fixing temperature set values T1 and T2 constantly even during printing operations.

Figure 17:
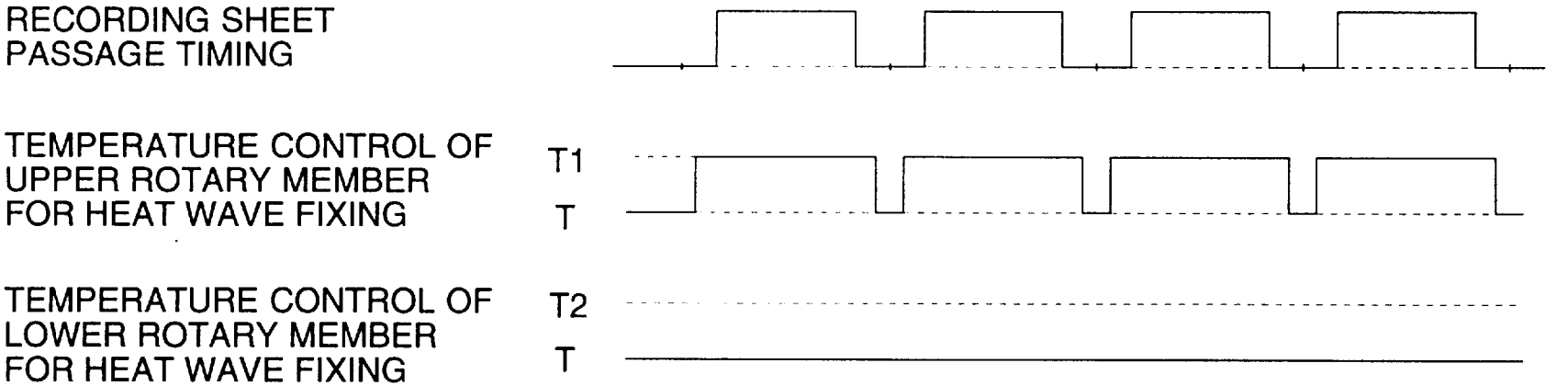
FIG. 17 is a temperature control timing chart in the continuous printing of single-sided image forming on the obverse side.

As shown in FIG. 17, with regard to the timing to convey recording sheet P passing through a fixing unit in the course of continuous printing for single-sided image forming for the obverse side image only, recording sheets are conveyed continuously in concert with continuous image forming on the obverse side conducted by photoreceptor drum 10, which is different from continuous printing for two-sided image forming and continuous printing for single-sided image forming for the reverse side. Therefore, on the upper roll-shaped rotary member for heat ray fixing for fixing toner images of the obverse side image, heat ray irradiating member 171*g* representing an upper heat ray irradiating means is turned on to be heated in synchronization with the timing for recording sheet P to pass, thus, there is conducted temperature control of the upper rotary member for heat ray fixing for alternate levels of fixing temperature set value T for suspension of image forming and appropriate fixing temperature set value T1 for image forming. During copying operations of single-sided image forming for the obverse side, the heat ray irradiating member 171*g* is turned on to be heated before the recording sheet P passes, and control of heating temperature for the upper rotary member for heat ray fixing is conducted, so that the temperature may be kept at the appropriate fixing temperature set value T1 in the course of image forming.

On the lower roll-shaped rotary member for heat ray fixing, on the other hand, heating control is not conducted to leave as it is during copying operations for single-sided image forming for the obverse side, or temperature control for the lower rotary member for heat ray fixing is conducted, so that the temperature may be kept at the fixing temperature set value T1 in the course of suspension of image forming.

Temperature control is conducted by fixing temperature. set values T, T1 and T2 stored in ROM in advance and by detection by temperature sensors TS1 and TS2 through comparative circuits and a control section (see FIG. 4).

In FIG. 17, temperature control for upper rotary member for heat ray fixing is conducted in the area where the leading edge and trailing edge of recording sheet P are nipped. However, when the linear speed is high, the temperature control timing is set to be earlier slightly, or it is even necessary to set to fixing temperature set value T1 constantly even during printing operations.

Figure 18:
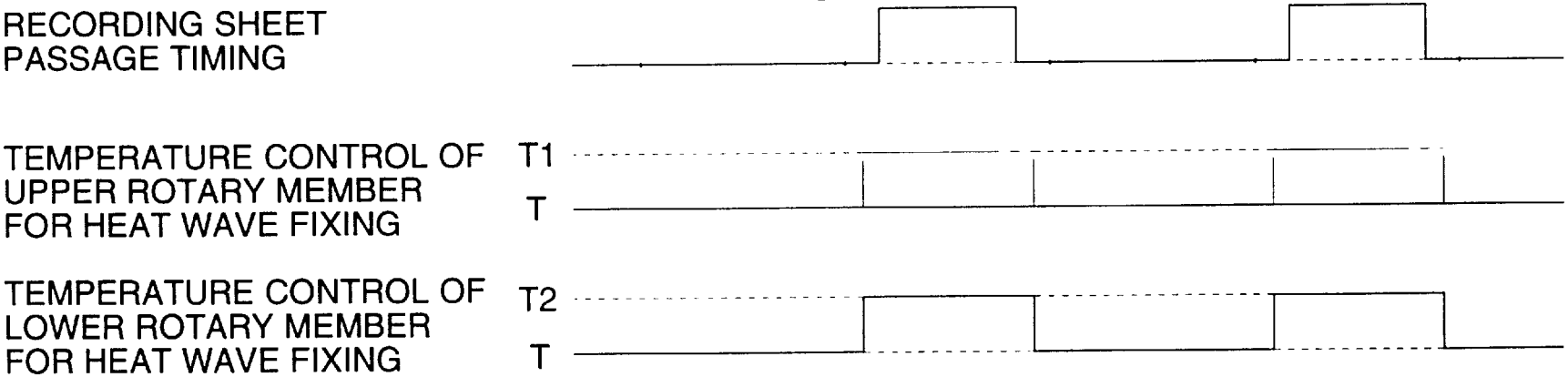
FIG. 18 is a temperature control timing chart in the continuous printing of single-sided image forming on the reverse side.

As is shown in FIG. 18, in the timing for conveying recording sheet P passing through a fixing unit in concert with image forming for the reverse side by intermediate transfer belt 14*a* in the course of continuous printing for single-sided image forming for the reverse side, conveyance is conducted at an interval of one recording sheet intermittently, which is different from continuous printing for single-sided image forming for the obverse side. In this case, on the upper roll-shaped rotary member for heat ray fixing for fixing toner images of the reverse side image, heat ray irradiating member 171*g* representing an lower heat ray irradiating means is turned on to be heated in synchronization with the timing for recording sheet P to pass, thus, there is conducted temperature control of the lower rotary member for heat ray fixing for alternate levels of fixing temperature set value T for suspension of image forming and appropriate fixing temperature set value T2 for image forming. During copying operations of single-sided image forming for the reverse side, the heat ray irradiating member 171*g* is turned on to be heated before the recording sheet P passes, and control of heating temperature for the lower rotary member for heat ray fixing is conducted, so that the temperature may be kept at the appropriate fixing temperature set value T2 in the course of image forming.

On the upper roll-shaped rotary member for heat ray fixing, on the other hand, heating control is not conducted to leave as it is during copying operations for single-sided image forming for the reverse side, or temperature control for the lower rotary member for heat ray fixing is conducted, so that the temperature may be kept at the fixing temperature set value T for suspension of image forming.

On the upper rotary member for heat ray fixing, it is preferable that heat ray irradiating member 171*g* is turned on to be heated to keep appropriate fixing temperature set value T1 for image forming before recording sheet P passes, in the course of copying operations for single-sided image forming for the reverse side, as shown with one-dot chain lines in FIG. 18, and when the upper rotary member for heat ray fixing is turned on to be heated, the tip of the nipping section T is overheated and thereby toner is not disturbed when recording sheet P is inserted into the nipping section, thus fixing of toner images for single-sided image for the reverse side only can be conducted in good condition.

Temperature control is conducted by fixing temperature set values T, T2 and (T1) stored in ROM in advance and by detection by temperature sensors TS1 and TS2 through comparative circuits and a control section (see FIG. 4).

In FIG. 18, temperature control for the lower rotary member for heat ray fixing and the upper rotary member for heat ray fixing is conducted in the area where the leading edge and trailing edge of recording sheet P are nipped. However, when the linear speed is high, the temperature control timing is set to be earlier slightly, or it is even necessary to set to fixing temperature set values T2 and (T1) constantly even during printing operations.

According to FIGS. 16–18, fixing of toner images for single-sided image forming for the obverse side, single-sided image forming for the reverse side and two-sided image forming is conducted by the upper and lower roll-shaped rotary members for heat ray fixing for instant heating wherein heat capacity is small and quick start is possible. Therefore, excellent fixing can be conducted without providing warming-up time. In particular, for image forming for two-sided image forming and for single-sided image forming for the reverse side, sheet conveyance is conducted at an interval of one sheet intermittently. Therefore, heat capacity of the lower rotary member for heat ray fixing which is smaller compared with that of a conventional heat fixing roller is enough for fixing of the toner images on the reverse side, thus, fixing of the reverse side images can be conducted by the lower rotary member for heat ray fixing.

Incidentally, the image forming apparatus can be set so that temperature is controlled automatically to the state of two-sided image forming, when a power switch is turned on for initial operation or when a pause mode is changed to a print operation mode, or it can be controlled so that the upper and lower rotary members for heat ray fixing may be turned off from heating when the apparatus is out of operation for a certain period of time or longer.

The structure explained above makes it possible to provide a fixing unit wherein each of single-sided image forming for the obverse side only, single-sided image forming for the reverse side only and two-sided image forming has its own energy consumption, and compared with a conventional fixing unit in which a heat generator is used in each of upper and lower rollers, each of single-sided image forming and two-sided image forming has its own appropriate energy consumption which is little, and compared with a conventional fixing unit employing a heat generator in each of upper and lower rollers and with a conventional film fixing unit employing a ceramic heater, a nipping width in the fixing area is wide, high fixing efficiency can be obtained, and two-sided fixing with low heat capacity and with zero warming-up time is possible.

Figure 19:
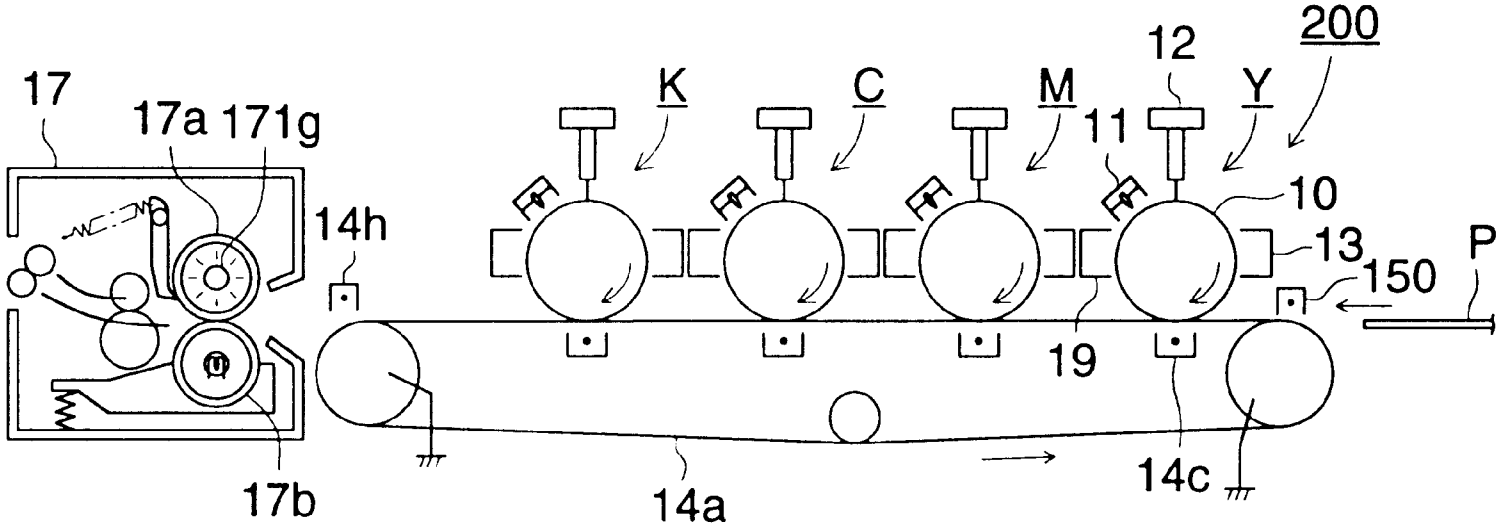
FIG. 19 is a diagram showing another example of a color image forming apparatus.

Another example of a color image forming apparatus is shown in FIG. 19.

The present example is an example of a color image forming in a tandem color image forming apparatus wherein four sets of image forming bodies are arranged in parallel to form toner images for Y, M, C and K and to transfer them in succession.

According to FIG. 19, toner image forming unit 200 composed of photoreceptor drum 10 (image forming body), scorotron charging unit 11 (charging means), exposure optical system 12 (image writing means), developing unit 13 (developing means) and cleaning unit 19 (image forming body cleaning means) is provided for Y, M, C and K, and a toner image formed on recording sheet P representing a transfer material attracted to conveyance belt 14*a* by charging of sheet charging unit 150 representing a sheet charging means and fed to the transfer area in synchronization with color toner images formed on photoreceptor drum 10 by each of toner image forming units 200 for Y, M, C and K is transferred in succession by transfer unit 14*c* representing a transfer means for Y, M, C and K provided to face toner image forming unit 200 through conveyance belt 14*a* and is impressed with voltage having polarity opposite to that of toner (positive polarity in the present embodiment) at the transfer area, to form superposed color toner images, thus, a color image is obtained.

Recording sheet P on which a color toner image is formed is separated from conveyance belt 14*a* by neutralizing action conducted by sheet separation AC neutralizing unit 14*h* representing a transfer material separating means provided on the end portion of conveyance belt 14*a,* then is conveyed to fixing unit for color toner 17, and is nipped by nipping section T formed between heat ray fixing roller 17*a* representing an upper roll-shaped rotary member for heat ray fixing having elasticity for fixing toner images and fixing roller 47*a* representing a lower roll-shaped rotary member for fixing, where the recording sheet P is applied with heat and pressure so that color toner images thereon are fixed, and then is ejected out of the apparatus.

As the fixing unit 17 stated above, fixing unit for color toner 17 having the same structure, functions and capacities as those explained in FIG. 5 is used. Further, even in the color image forming apparatus of the present example, a fixing unit having the same structure, functions and capacities as those explained in FIG. 11 is used, and the same control for temperature in color image forming as that explained in FIG. 17 is conducted.

Therefore, in the present example again, fusion of superposed color toner images on a transfer material having a thick toner layer difficult to be fixed by heat ray due to different spectral characteristics can be carried out satisfactorily, when the superposed color toner images are fixed by pressurization at the fixing section (nipping section) by elasticity of the rotary member for heat ray fixing and by heating by a heat ray absorbing layer of the rotary member for heat ray fixing, and a color image forming apparatus wherein instant heating fixing for color toner images having functions of a soft roller and quick start fixing requiring short heating time can be provided.

In the invention, as stated above, when fixing unit for color toner 17 same as that explained in FIG. 5 or fixing unit for color toner 17 same as that explained in FIG. 10 is used, the fixing unit for color toner turns out to be one which is resistant to deformation of the fixing section (nipping section) and is for quick start fixing by instant heating. When the fixing unit for color toner is used in the color image forming apparatus explained in FIG. 19, in particular, instant heating fixing with quick start for color toner images is possible for color image forming, and energy in an appropriate amount is consumed on a rotary member for heat ray fixing, thus an effect of energy conservation is obtained. In the conventional fixing unit for color toner employing a heat generator in either an upper soft roller or a lower soft roller, a rubber layer used as an elastic layer is deteriorated, because temperature of a core metal is raised to shorten the warming-up time at the start, in particular, in the case of a soft roller whose core metal is a metal pipe. In addition, the rubber layer has poor heat conductivity, making the warming-up time to be long. Compared with this, in the case of the present rotary member for heat ray fixing employing an elastic layer, there is provided a fixing unit for color toner and a color image forming apparatus wherein deterioration is less because no excessive heating takes place on the elastic layer, a life of the rotary member for heat ray fixing is long, and fixing with low heat capacity and zero warming-up time is possible.

When fixing unit 17 explained in FIG. 11 or FIG. 15 is used as stated above, heat is absorbed by a heat conduction layer or by a combination-type layer and is made uniform, thus it is possible to fix by using heat rays capable of instant heating or of quick start requiring short heating time. Further, fusion of color toner difficult to be fixed by heat ray due to different spectral characteristics can be carried out satisfactorily, by pressurization at the soft fixing section (nipping section) by an elastic layer and by heating by a heat ray absorbing layer or a combination-type layer, which makes instant heating fixing for color toner having functions of a soft roller and quick start fixing requiring short heating time possible. Further, a light transmitting base body is strongly protected by a heat conduction layer or a combination-type layer, and damage of the light transmitting base body is prevented. When used in an image forming apparatus explained in FIG. 1, in particular, quick start and instant heating fixing for toner images in the course of two-sided image forming and single-sided image forming for the obverse side or the reverse side is made to be possible, and an effect of energy conservation is obtained. Further, fusion of superposed color toner images on a transfer material having a thick toner layer difficult to be fixed by heat ray due to different spectral characteristics can be carried out satisfactorily by the fixing conducted by pressurization at the soft fixing section (nipping section) by elasticity of an elastic layer of the rotary member for heat ray fixing and by heating by a heat ray absorbing layer of the rotary member for heat ray fixing or by a combination-type layer, and instant heating fixing for color toner images or quick start fixing requiring short heating time can be made possible. In the conventional fixing unit for color toner employing a heat generator in either an upper soft roller or a lower soft roller, a rubber layer used as an elastic layer is deteriorated, because temperature of a core metal is raised to shorten the warming-up time at the start, in particular, in the case of a soft roller whose core metal is a metal pipe. In addition, the rubber layer has poor heat conductivity, making the warming-up time to be long. Compared with this, in the case of the present rotary member for heat ray fixing employing an elastic layer, there is provided a fixing unit for color toner and a color image forming apparatus wherein deterioration is less because no excessive heating takes place on the elastic layer, a life of the rotary member for heat ray fixing is long, and fixing with low heat capacity and zero warming-up time is possible.

What is claimed is:

1. A color image forming apparatus comprising:

toner image forming means for forming a plurality of different color toner images on a transfer sheet;

a pair of cylindrical fixing rollers for nipping each said transfer sheet bearing each said color toner image formed by the toner image forming device and for fixing the color toner image on the transfer sheet;

at least one of the pair of cylindrical fixing rollers comprising, a heat ray irradiating means, a cylindrical light transmitting base member containing said heat ray irradiating means, an elastic layer on the cylindrical light transmitting base member, and a heat ray absorbing layer on the cylindrical light transmitting base member which absorbs 90% to 100% of heat rays passing through the cylindrical light transmitting base member.

2. The color image forming apparatus of claim 1, wherein the elastic layer is provided on an outer circumferential surface of the cylindrical light transmitting base member and the heat ray absorbing layer provided on an outer circumferential surface of the elastic layer.

3. The color image forming apparatus of claim 1, wherein the heat ray absorbing layer is used as the elastic layer.

4. The color image forming apparatus of claim 1, wherein the heat ray absorbing layer absorbs 95% to 100% of the heat ray passing the cylindrical light transmitting base member.

5. The color image forming apparatus of claim 1, wherein the toner image forming means comprises an image carrying member on which a toner image is formed and transferring means for transferring the toner image onto the transfer sheet.

6. The color image forming apparatus of claim 1, wherein the other one of the pair of cylindrical fixing rollers is a hard roller.

7. The color image forming apparatus of claim 1, wherein the other one of the pair of cylindrical fixing rollers is a soft roller comprising an elastic layer.

8. The color image forming apparatus of claim 1, wherein the thickness of the heat ray absorbing layer is 10 $\mu$m to 200 $\mu$m.

9. The color image forming apparatus of claim 8, wherein the thickness of the heat ray absorbing layer is 20 $\mu$m to 100 $\mu$m.

10. The color image forming apparatus of claim 1, wherein the thickness of the elastic layer is 0.5 mm to 20 mm.

11. The color image forming apparatus of claim 1, wherein the one of the pair of cylindrical fixing rollers further comprises a heat conductive layer.

12. The color image forming apparatus of claim 11, wherein the thickness of the heat conductive layer is 10 $\mu$m to 1000 $\mu$m.

13. The color image forming apparatus of claim 11, wherein the heat conductive layer is provided on an outer circumferential surface of the heat ray absorbing layer.

14. The color image forming apparatus of claim 11, wherein the heat ray absorbing layer is used as the heat conductive layer.

15. A fixing roller for fixing a color toner image comprising:

a cylindrical light transmitting base member containing a heat ray irradiating means can be provided therein, an elastic layer on the cylindrical light transmitting base member, and a heat ray absorbing layer on the cylindrical light transmitting base member which absorbs 90% to 100% of the heat rays passing through the cylindrical light transmitting base member.

16. The fixing roller of claim 15, wherein the heat ray absorbing layer absorbs 95% to 100% of the heat ray passing the cylindrical light transmitting base member.

17. The fixing roller of claim 15, wherein the elastic layer is provided on an outer circumferential surface of the cylindrical light transmitting base member and the heat ray absorbing layer provided on an outer circumferential surface of the elastic layer.

18. The fixing roller of claim 15, wherein the heat ray absorbing layer is used as the elastic layer.

19. The fixing roller of claim 15, wherein the thickness of the elastic layer is 0.5 mm to 20 mm.

20. The fixing roller of claim 15, further comprising a heat conductive layer.

21. The fixing roller of claim 20, wherein the thickness of the heat conductive layer is 10 $\mu$m to 1000 $\mu$m.

* * * * *